US009952534B2

(12) United States Patent
Nakase

(10) Patent No.: US 9,952,534 B2
(45) Date of Patent: Apr. 24, 2018

(54) IMAGE FORMING APPARATUS HAVING DEVELOPER SUPPLY CONTROL

(71) Applicant: CANON KABUSHIKI KAISHA, Tokyo (JP)

(72) Inventor: Takahiro Nakase, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/351,635

(22) Filed: Nov. 15, 2016

(65) Prior Publication Data

US 2017/0139347 A1 May 18, 2017

(30) Foreign Application Priority Data

Nov. 16, 2015 (JP) ..... 2015-224084

(51) Int. Cl.
*G03G 15/08* (2006.01)
*G03G 15/20* (2006.01)
*G03G 15/00* (2006.01)

(52) U.S. Cl.
CPC ..... *G03G 15/0831* (2013.01); *G03G 15/0856* (2013.01); *G03G 15/2039* (2013.01); *G03G 15/556* (2013.01); *G03G 15/086* (2013.01)

(58) Field of Classification Search
CPC ..... G03G 15/0831; G03G 15/0856; G03G 15/556
USPC ..... 399/27, 258
See application file for complete search history.

(56) References Cited

U.S. PATENT DOCUMENTS 5,787,320 A * 7/1998 Eun ..... G03G 15/0849 399/260
2006/0127109 A1* 6/2006 Itoyama ..... G03G 15/0853 399/27

FOREIGN PATENT DOCUMENTS

JP 2004-206018 A 7/2004
JP 2011-209464 A 10/2011

* cited by examiner

*Primary Examiner* — Sandra Brase
(74) *Attorney, Agent, or Firm* — Fitzpatrick, Cella, Harper & Scinto

(57) ABSTRACT

An image forming apparatus includes an image bearing member, and a developing device including a developing container accommodating a one component developer including toner, and a developer detecting portion configured to detect the developer in the developing container. The developing device develops an electrostatic latent image formed on the image bearing member with the toner. In addition, a developer supply portion supplies the developer into the developing container in accordance with a detection result of the developer detecting portion, and a controller controls developer supply means, in which a developer amount in the developing container when an image ratio of images formed by a predetermined number of image formations is a first image ratio is larger than the developer amount in the developing container when the image ratio of the images formed by a predetermined image formations is a second image ratio which is smaller than the first image ratio.

13 Claims, 13 Drawing Sheets

IMAGE FORMING APPARATUS HAVING DEVELOPER SUPPLY CONTROL

FIELD OF THE INVENTION AND RELATED ART

The present invention relates to an image forming apparatus such as a copying machine, a facsimileing machine, a printing machine, and multifunction machine having two or more functions of the preceding machines.

An image forming apparatus which employs an electrophotographic method or the like forms an electrostatic latent image on its photosensitive drum (image bearing member), and develops the electrostatic latent image into a toner image, that is, an image formed of toner, with the use of its developing device. Thus, as it forms an image, the toner (developer) in the developer container of the developing device is consumed. Therefore, it has been proposed to place a toner sensor for detecting toner, in the developer container, for example, and replenish the developer container with toner if the signal (voltage) outputted by the toner sensor remains no more than a preset value (threshold value) for a preset length of time (Japanese Laid-open Patent Application No. 2004-206018, for example).

As an image forming apparatus increases in the cumulative number of times it was used for image formation, the toner in its developer container increases in degree of agglomeration, increasing thereby the probability with which the toner sensor makes detection errors; it determines that there is no toner in the developer container even through there is. In the case of the image forming apparatus disclosed in Japanese Laid-open Patent Application No. 2004-206018, the threshold value for the toner sensor is changed in response to the increase in the cumulative number of times the image forming apparatus was used for image formation. More concretely, the apparatus is structured so that if the length of time the toner sensor continuously detected the absence of toner in the developer container becomes greater than a threshold value, the apparatus begins to replenish its developer container with toner. Further, in order to control the apparatus so that the greater the cumulative number of time the apparatus was used for image formation, the less likely it is for the apparatus to begin to replenish the developer container with toner, the threshold value for the toner sensor is increased in proportion to the cumulative number of times the apparatus was used for image formation.

However, in a case where an image forming apparatus is structured like the one disclosed in Japanese Laid-open Patent Application No. 2004-206018, the threshold value for the toner sensor is simply changed in response to the increase in the cumulative numbers of the image formation by the apparatus. Thus, if the developer in the developer container is deteriorated by being in the container for a long time, it is possible that the structure of this image forming apparatus will not be able to satisfactorily prevent the developer in the developer container from increasing in degree of agglomeration. For example, if the apparatus is used to continuously form images which are low in image ratio, it takes a substantial length of time for the developer in the developer container to be completely replaced by a fresh supply of developer, because an image which is low in image ratio is small in the amount by which developer is consumed for its formation. Thus, the developer in the developer container is likely to remain in the developer container for a substantial length of time. Therefore, it is likely to deteriorate and increase in degree of agglomeration.

The present invention was made in consideration of the above-described issue. Thus, the primary object of the present invention is to provide such a design for an electrophotographic image forming apparatus that can reduce the length of time necessary to completely replace the developer in the developer container with a fresh supply of developer, in order to prevent the developer in the developer container from increasing in degree of agglomeration, even when an image forming apparatus is operated in an environment in which developer is likely to deteriorate.

SUMMARY OF THE INVENTION

According to an aspect of the present invention, there is provided an image forming apparatus comprising an image bearing member; a developing device including a developing container accommodating a one component developer including toner, and a developer detecting portion configured to detect the developer in said developing container, said developing device being configured to develop an electrostatic latent image formed on said image bearing member with the toner; a developer supply portion configured to supply the developer into said developing container in accordance with a detection result of said developer detecting portion; and controlling means configured to control said developer supply means, in which a developer amount in said developing container when an image ratio of images formed by a predetermined number of image formations is a first image ratio is larger than the developer amount in said developing container when the image ratio of the images formed by a predetermined image formations is a second image ratio which is smaller than the first image ratio.

According to another aspect of the present invention, there is provided an image forming apparatus comprising an image bearing member; a developing device including a developing container accommodating a one component developer including toner, and a developer detecting portion configured to detect the developer in said developing container, said developing device being configured to develop an electrostatic latent image formed on said image bearing member with the toner; a developer supply portion configured to supply the developer into said developing container in accordance with a detection result of said developer detecting portion; and controlling means configured to control said developer supply means, in which a developer amount in said developing container when an image ratio of images formed in a predetermined image forming operation period is a first image ratio is larger than the developer amount in said developing container when the image ratio of the images formed in a predetermined image forming operation period is a second image ratio which is smaller than the first image ratio.

Further features of the present invention will become apparent from the following description of exemplary embodiments with reference to the attached drawings.

DESCRIPTION OF THE EMBODIMENTS

Embodiment 1

Referring to FIGS. 1-14, the first embodiment of the present invention is described. To begin with, referring to FIG. 1, the image forming apparatus in this embodiment is described about its general structure.

<Image Forming Apparatus>

The image forming apparatus 100 in this embodiment is a multifunction printer. It is capable of continuously forming black-and-white images, for example, on sheets m of recording medium, such as sheets of recording paper of size A4, one for one, at a preset speed, which can be set to as high as 100 page/min.

Figure 1:
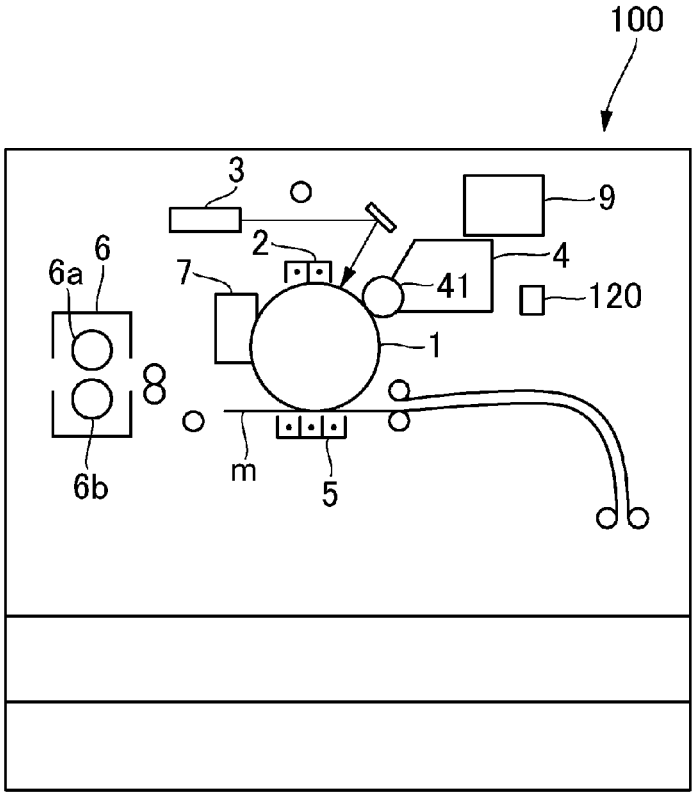
FIG. 1 is a sectional view of the image forming apparatus in the first embodiment of the present invention, and is for describing the structure (design) of the apparatus.

The image forming apparatus 100 has a photosensitive drum 1 (photosensitive member) as an image bearing member, which is rotationally driven in the clockwise direction in FIG. 1. As the photosensitive drum 1 is rotationally driven, its peripheral surface is uniformly charged by a primary charging device 2. Then, the uniformly charged portion of the peripheral surface of the photosensitive drum 1 is exposed by a laser scanner 3 as an exposing device, according to the information of an image to be formed. Consequently, an electrostatic latent image of the image to be formed is effected on the peripheral surface of the photosensitive drum 1. Then, the electrostatic latent image on the peripheral surface of the photosensitive drum 1 is developed into a toner image by a combination of the developing device and toner (developer). As the toner in the developing device is consumed by image formation, the developing device 4 is replenished with a fresh supply of toner by an amount proportional to the amount of toner consumption, from a toner replenishment device 9.

After the formation of a toner image on a sheet m of recording medium, the sheet m is conveyed between the photosensitive drum 1 and a transferring device 5. As the sheet m is conveyed between the photosensitive drum 1 and transferring device 5, transfer bias is applied between the photosensitive drum 1 and transferring device 5, whereby the toner image is transferred from the photosensitive drum 1 onto the sheet m. Then, the sheet m is pressed and heated by a fixing device 6 as a heating device, whereby the toner image on the sheet m is fixed to the sheet m, ending the image formation. Then, the sheet m to which the toner image has just been fixed is discharged out of the main assembly of the image forming apparatus 100. The toner particles remaining on the peripheral surface of the photosensitive drum 1 after the primary transfer are removed by a cleaning device 7 as a cleaning device, to prepare the peripheral surface of the photosensitive drum 1 for the next image formation.

<Developing Device>

Figure 2:
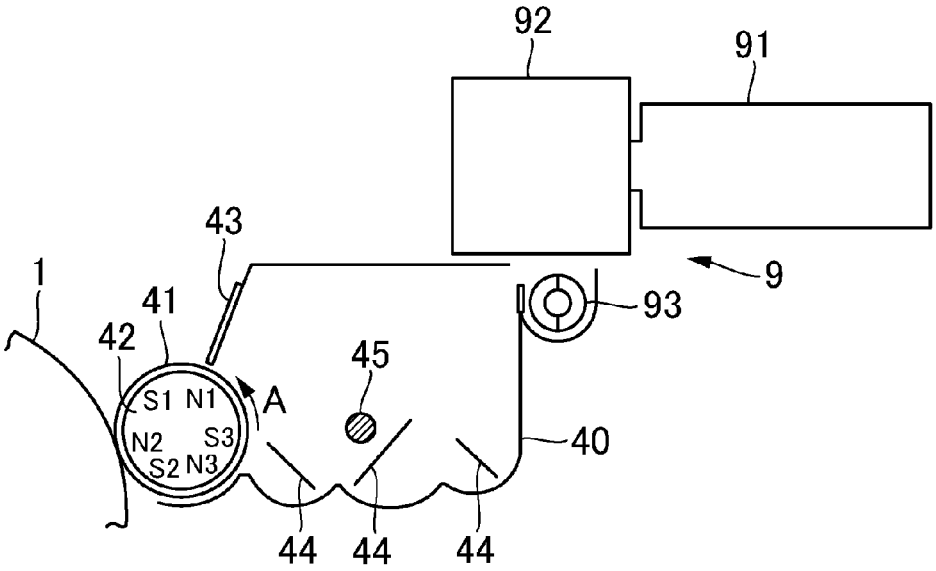
FIG. 2 is a schematic sectional view of the developing device in the first embodiment, and is for describing the structure (design) of the developing device.
Figure 3:
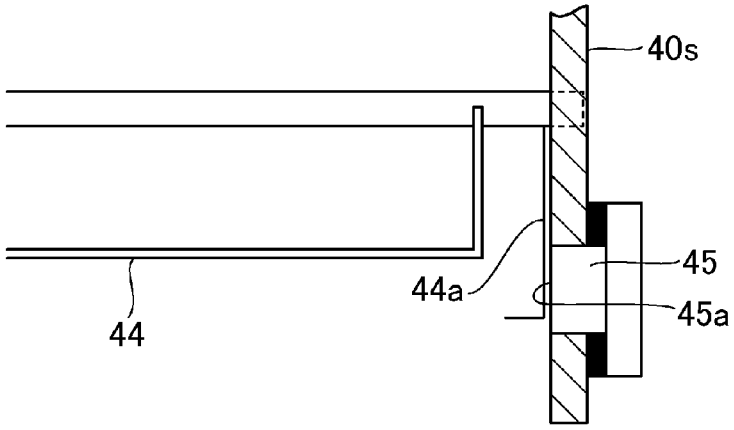
FIG. 3 is a schematic sectional view of the toner sensor of the developing device in the first embodiment, and the adjacencies of the sensor.

Next, referring to FIGS. 2 and 3, the developing device 4 in this embodiment is described. The developing device 4 has a developer container 40, in which powdery developer (toner) is stored. In this embodiment, the developer is single-component developer, the primary component of which is magnetic toner. When the developer container 40 is brand-new (when it is put to use for the first time), it contains 200 g of magnetic single-component developer.

The developer container 40 is formed of a resinous substance which contains glass fibers. It is provided with an opening which faces the photosensitive drum 1. It is also provided with a cylindrical toner bearing member 41, which is rotatably supported by the developer container 40 so that it is exposed toward the photosensitive drum 1 through the abovementioned opening. The toner bearing member 41 is rotationally driven in the direction indicated by an arrow mark A. Further, the developing device 4 is provided with a stationary permanent magnet 42, which is disposed in the hollow of the toner bearing member 41. The toner in the developer container 40 is made to be borne on the toner bearing member 41 by the magnetic force of the permanent magnet.

As the toner is made to be borne on the peripheral surface of the toner bearing member 41, it forms a toner layer. Then, as the toner bearing member 41 is rotated further, the toner layer on the toner bearing member 41 is regulated in thickness by a regulation blade 43, which is disposed so that a preset amount of gap is provided between the regulating edge of the regulation blade 43 and the peripheral surface of the toner bearing member 41. Then, the toner layer is conveyed to an area in which it opposes the peripheral surface of the photosensitive drum 1, and in which a preset amount of gap is provided between the toner bearing member 41 and photosensitive drum 1. As development bias is applied between the toner bearing member 41 and photosensitive drum 1, the toner particles in the toner layer on the toner bearing member 41 are made to fly to the electrostatic latent image on the photosensitive drum 1. Consequently, a toner image which reflects the information of the image to be formed is formed on the photosensitive drum 1.

Further, the developing device 4 is provided with multiple stirring-conveying members 44, which are in the form of a ladder. The stirring-conveying members 44 are disposed in the developer container 40. As the multiple stirring-conveying members 44 are rotated, each of them conveys the toner in the developer container 40 toward the toner bearing member 41, while stirring the toner as the developer container 40 is replenished with a fresh supply of toner. Further, the developing device 4 is provided with a toner sensor 45 as a developer detecting means which detects the toner in the developer container 40. The toner sensor 45 is disposed in the developer container 40. It is made up of a piezoelectric element, and an electric circuit which converts the voltage which the piezoelectric element generates as it is made to vibrate, into electrical signals. The toner sensor 45 outputs electrical signals, the strength of which is proportional to the amount of the toner in the developer container 40.

Referring to FIG. 3, in this embodiment, the toner sensor 45 is attached to the wall 40*s* of the developer container 40, being positioned at a preset height from the bottom surface of the developer container 40, so that its detection surface 45*a* is exposed inward of the developer container 40. It is capable of detecting whether or not the upwardly facing surface of the body of toner in the developer container 40 is higher in position than a preset level. That is, the toner sensor 45 can detect the amount of the toner remaining in the developer container 40. The stirring-conveying member 44 is provided with a cleaning member 44*a*, which is attached to the shaft of the stirring-conveying member 44 in such a manner that as the stirring-conveying member 44 is rotated, the cleaning member 44*a* rotates along the wall 40*s*. That is, the developing device 4 is structured so that as the cleaning member 44*a* is rotated by the rotation of the stirring-conveying member 44, the toner having adhered to the detection surface 45*a* of the toner sensor 45 is removed by the cleaning member 44*a*.

<Toner Replenishment Device>

The toner replenishment device 9 has a toner cartridge 91, a buffer portion 92, and a toner replenishment roller 93 as a means for replenishing the developing device 4 with a fresh supply of developer (toner), etc. The toner cartridge 91 contains toner. The toner from the toner cartridge 91 is temporarily stored in the buffer portion 92. As the toner replenishment roller 93 is rotated, the toner stored in the buffer portion 92 is supplied into the developer container 40. The toner replenishment roller 93 is driven in response to the results of the detection by the toner sensor 45, as will be described later in detail.

<Control of Image Forming Apparatus>

Figure 4:
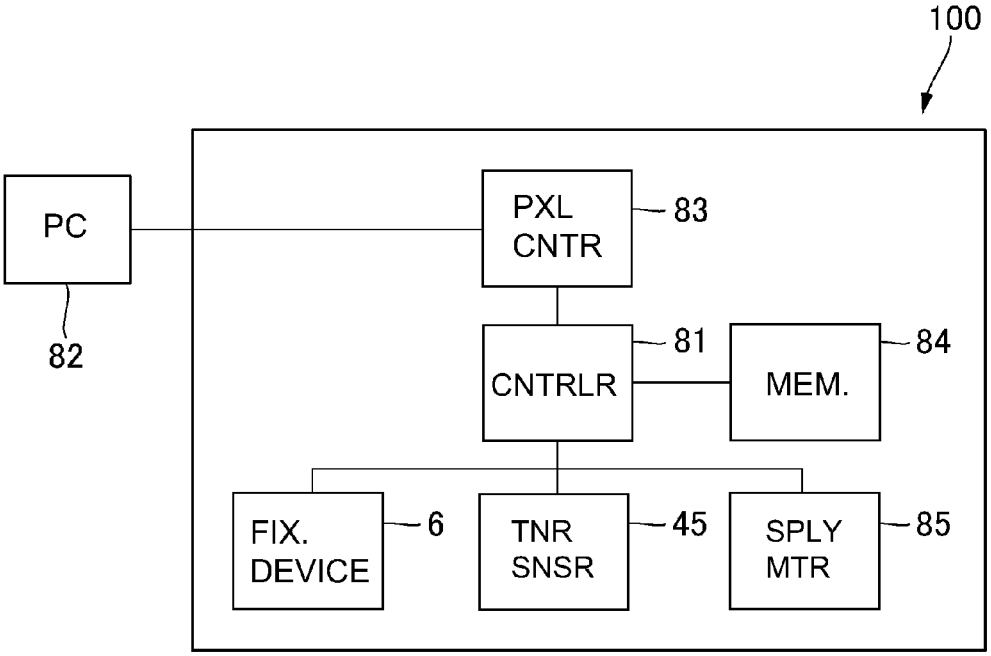
FIG. 4 is a block diagram of the portion of the image forming apparatus related to the present invention.

Next, the control of the image forming apparatus structured as described above is concretely described. Referring to FIG. 4, a control device 81 is a means for controlling the image forming apparatus 100. It controls various portions in the image forming apparatus 100. In this embodiment, the control device 81 receives, by way of pixel controller 83, an image formation start command (image formation job start command) from a peripheral device 82 such as a personal computer connected to the image forming apparatus 100. As it receives the command, it begins to rotate the photosensitive drum 1 at a preset peripheral velocity (process speed), for example, 500 mm/s, with the use of an unshown motor (driving force source). Further, it applies bias to the primary charging device 2 with the use of an unshown electrical power source, to uniformly charge the peripheral surface of the photosensitive drum 1 to +500 V, for example.

Next, the control device 81 makes the laser scanner 3 emit a beam of laser light to form an electrostatic latent image, at a resolution of 600 dpi in terms of both the direction parallel to the rotational axis of the photosensitive drum 1 and the direction parallel to the rotational direction of the photosensitive drum 1.

Figure 5A:
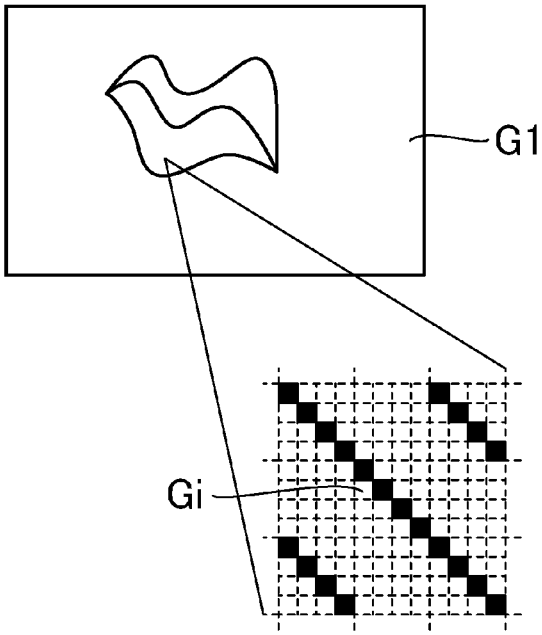
FIG. 5A is a schematic drawing for describing the composition of the halftone portions of an image.

Here, referring to FIG. 5A, a halftone image G1 is formed by forming multi-value dots in a preset pattern. More concretely, it is made up of multiple (preset number of) picture elements Gi, each of which is made up of 4×4 dots (four columns×four rows) placed per unit area of a preset size. The laser used for exposure is kept constant in intensity. However, the greater the length of time a picture element is exposed to the beam of laser light, the lower in potential level the picture element becomes, and therefore, the greater in the amount by which toner adheres thereto. That is, the greater a picture element in the length of time it is exposed to the beam of laser light, the higher it becomes in toner density as it is developed. In other words, the tone of each dot can be set in multiple grades by varying dot in size and depth in terms of an electrostatic latent image.

Figure 5B:
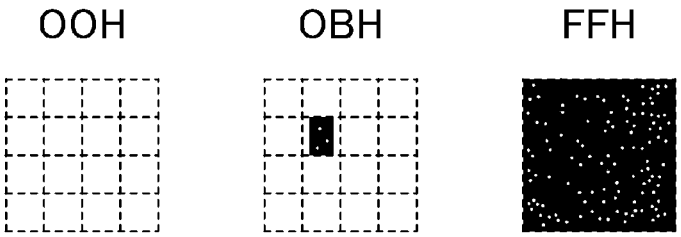
FIG. 5B is a collection of three examples of screen pattern of a dot (pixel) of an image.

The tone of each picture element Gi can be set to one of 256 levels. FIG. 5B shows 256 levels of tone in three digit number in hexadecimal system (00H-FFH). A dot which is "00H" in tone is lowest in density. That is, it corresponds to a white area of an image. A dot which is "FFH" in tone is highest in density. It corresponds to a black area of an image. By the way, the potential level of a dot which is FFH in tone is in a range of 150-200 V.

Further, the control device 81 makes the toner bearing member 41 of the developing device 4 rotate in the direction indicated by the arrow mark A at 600 mm/s, for example, in peripheral velocity, and stirring-conveying member 44 rotate at 30 rpm, for example. Further, it applies development voltage, more specifically, such voltage that is 350-400 V in average potential level, 1300 V in amplitude, 2400 Hz in frequency, and rectangular in waveform, between the toner bearing member 41 and photosensitive drum 1, with the use of an unshown electric power source. Thus, the electrostatic latent image on the photosensitive drum 1 is developed by toner.

The toner in the developer container 40 is consumed by an image forming operation such as the above-described one. Thus, the control device 81 detects the remaining amount of toner in the developer container with the use of the toner sensor 45. Then, if the detected amount of the toner is no more than a preset value, the control device 81 drives the toner replenishment motor 85. The toner replenishment motor 85 is in connection to the toner replenishment roller 93. As the toner replenishment motor 85 is driven, the toner replenishment roller 93 rotates, whereby the toner in the buffer portion 92 is supplied to the developer container 40. The repetition of this process keeps the developer container 40 in the amount of toner therein. If this process fails to make the amount of the toner in the developer container 40 recover to the preset value, the control device 81 determines that the toner cartridge 91 became empty, and issues a command for prompting a user or the like to replace the toner cartridge 91 in the developing device 4 with a brand-new one.

<Toner Replenishment Control>

Figure 6:
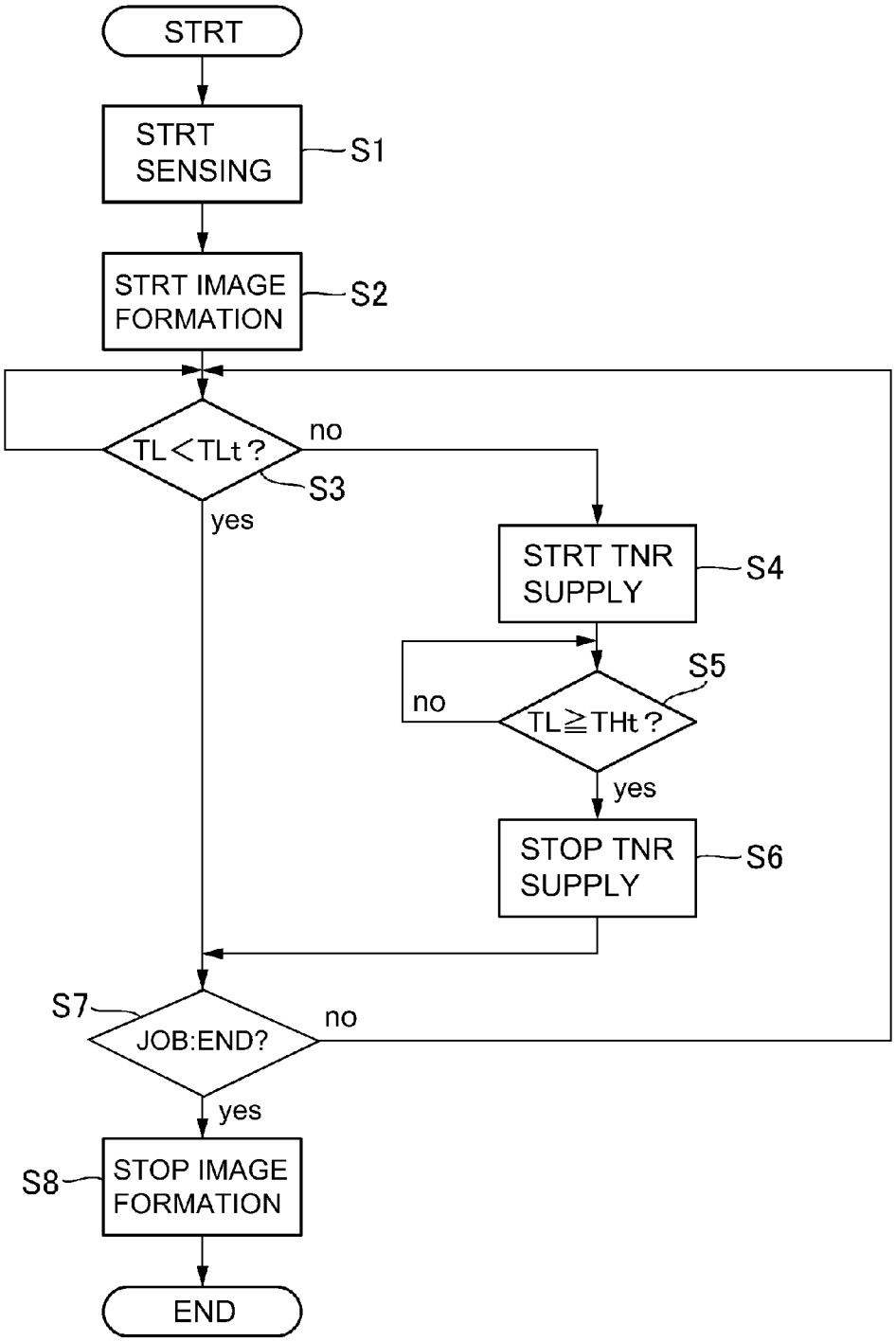
FIG. 6 is a flowchart of a control sequence for controlling the operation for replenishing the developer container with a fresh supply of toner, in the first embodiment.

Here, referring to FIG. 6 which is a flowchart, the control of the operation for replenishing the developer container 40 with a fresh supply of toner, in this embodiment, is described in detail. As soon as a user makes the image forming apparatus 100 start an image formation job, the control device 81 activates the toner sensor 45 (S1). The piezoelectric element of the toner sensor 45 outputs a signal S in response to vibrations. Then, the control device 81 makes the image forming apparatus 100 start image formation (S2). The toner in the developer container 40 is consumed by the image formation. The control device 81 checks whether or not the length (TL) of time the voltage of the signal S remained no more than a preset value is no more than a preset voltage threshold value (TL) (TL<TLt) (S3). If the job is completed while the length of time the voltage of the signal S remained no more than the preset voltage threshold value (S7), the control device 81 ends the image formation, without replenishing the developer container 40 with a fresh supply of toner.

If the job is not completed, the process (S3) for determining whether or not the developer container 40 needs to be replenished with toner is repeated until the job is completed. If the length of time (TL) the voltage of the signal S was no more than the preset value becomes no less than the preset value (TLt), the control device 81 determines that the amount of the toner in the developer container 40 is insufficient, and begins to rotate the toner replenishment roller 93 to replenish the developer container 40 with toner (S4). Further, the control device 81 determines whether or not the length of time (TH) the voltage of the signal S was no less than another preset value becomes no less than the preset value (TLt) (S5). If the length of time (TH) the voltage of the signal S was no less than the preset value becomes no less than the preset value (TLt), the control device 81 determines that the amount of the toner in the developer container 40 became sufficient, and stops replenishing the developer container 40 with toner (S6). If the job has not been completed at this point in time, the control device 81 returns to (S3) in which it determines whether or not the developer container 40 needs to be replenished with toner.

To describe more concretely, in this embodiment, the piezoelectric element of the toner sensor 45 outputs the signal S, the strength of which is proportional to the vibrations to which it is subjected, every 0.1 second. If the job ends (S7) while the length of time (TL) the voltage of the signal S remained no more than 1 V (preset value) is no more than the threshold value (TLt) (TL<TLt) (S3), the image formation is ended without replenishing the developer container 40 with toner (S8). If the state in which the voltage of the signal S remains no less than 2.5 V (another preset value) lasts no less than the preset threshold value (THt=0.6 sec) (S5), the control device 81 determines that the amount of the toner in the developer container 40 is satisfactory, and stops replenishing the developer container 40 with toner (S6).

Figure 7:
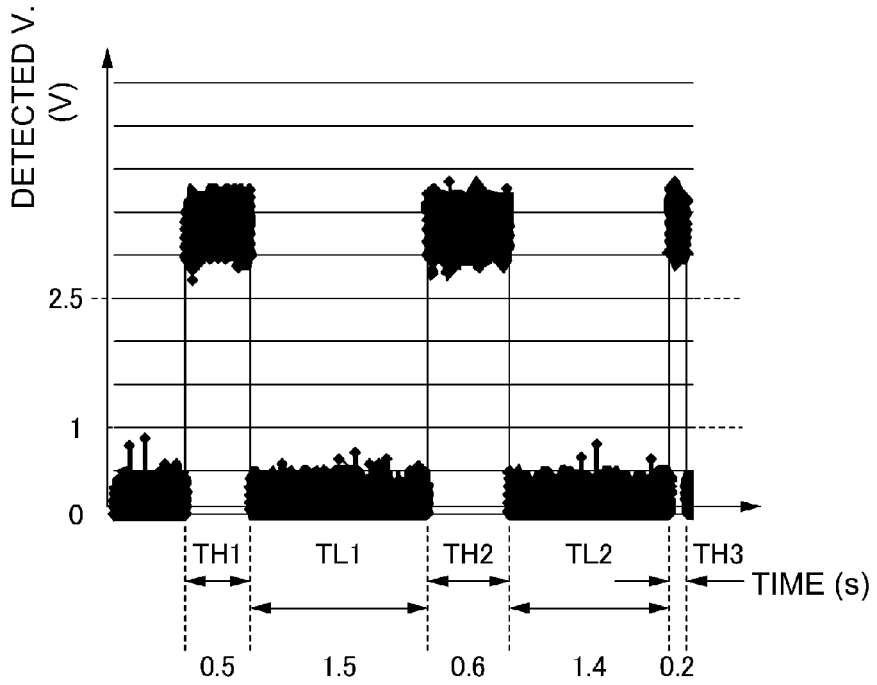
FIG. 7 is a drawing of an example of output of the toner sensor in the first embodiment.
Figure 8:
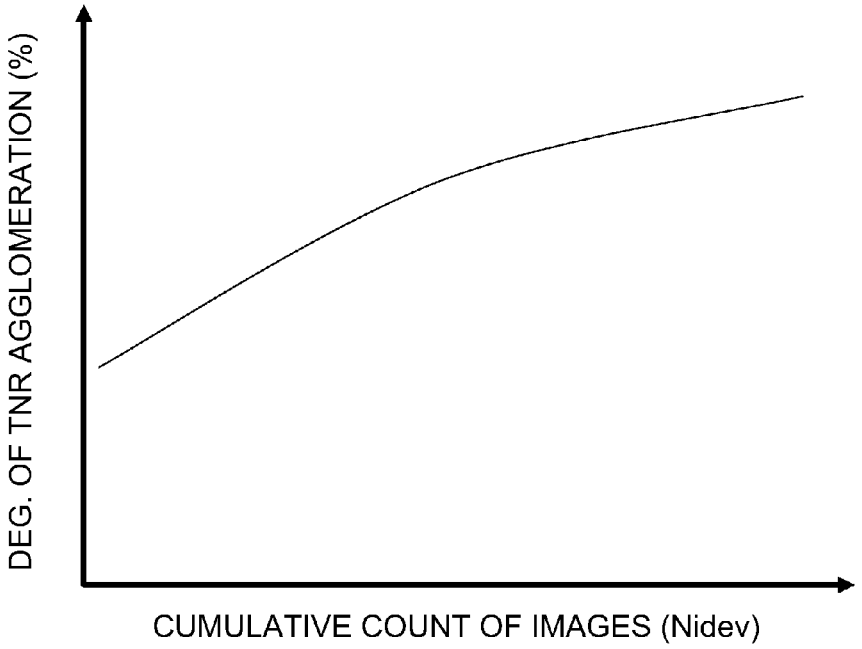
FIG. 8 is a drawing which shows the relationship between the cumulative count of images formed by the image forming apparatus, and the degree of toner agglomeration.

Here, an example of signal S which the toner sensor 45 outputs is shown in FIG. 7, which shows the values of the voltages detected by the toner sensor 45 before they were converted into the signal S. In reality, it is the value obtained by converting the AC voltage (detected voltage) into DC voltage that is sent as the signal S to the control device 81. Then, the control device 81 controls the process for replenishing the developer container 40 with toner, based on the signal S, as follows.

Here, a period in which the voltage of the signal S is no more than a preset value is referred to as "low voltage period", whereas a period in which the voltage of the signal S is no less than another preset value is referred to as "high voltage period". Referring to FIG. 7, prior to the first high voltage period (TH1), the control device 81 did not start the replenishing operation. In the first high voltage period, therefore, the control device 81 keeps the developing device 4 in the same state as the state in which it kept the developing device 4 prior to the first high voltage period. The first low voltage period (TL1) is 1.5 s in length, and therefore, TL1≥TLt (=1.5) is satisfied. Thus, the control device 81 determines that there is an insufficient amount of toner in the developer container 40, and begins to replenish the developer container 40 with toner. The second high voltage period (TH2) is 0.6 s in length, and satisfies TH2≤TLt (=1.5 s). Thus, the controlling device 81 determines that there is a sufficient amount of toner in the developer container 40, and stops replenishing the developer container 40 with toner. The second low voltage period (TL2) is 1.4 s in length, and therefore, it satisfies: TL2<TLt. Therefore, the control device 81 does not start replenishing the developer container 40 with toner. In the period prior to the third high voltage period (TH3), the control device 81 did not start replenishing the developer container 40 with toner. In the third high voltage period (TH3), the control device 81 keeps the developing device 4 in the same state as the state in which the developing device 4 was in the period prior to the third high voltage period (TH3). In this embodiment, the developer container 40 is kept stable in the amount of the toner therein, at a preset value, by the repetition of the above-described sequence, shown by the flowchart in FIG. 6, for replenishing the developer container 40 with toner.

However, as the image forming apparatus 100 (developing device 4) was simply controlled as described above, the toner in the developer container 40 increased in degree of agglomeration in proportion to the increase in the cumulative number (Nidev) of image formations. As the toner increases in degree of agglomeration, it is likely for the spaces among the toner particles to increase in size, and therefore, it is likely for the toner sensor 45 to increase in the probability with which it erroneously determines that there is no toner. Thus, the developing device 4 increases in the frequency with which it is replenished with toner (developer container 40 is replenished with an excessive amount of toner). Thus, the developing device 4 increases in the amount (Md) of the toner therein. Consequently, the torque necessary to drive the stirring-conveying member 44, which is for stirring the toner in the developer container 40, increases, making it possible for the image forming apparatus 100 to abruptly stop.

Further, as the toner in the developer container 40 increases in degree of agglomeration, it is possible for the toner to adhere to the toner sensor 45. As the toner adheres to the toner sensor 45, it is possible that the cleaning member 44*a* attached to the shaft of the stirring-conveying member 44 will fail to remove the toner from the toner sensor 45, or will break. If the cleaning member 44*a* fails to remove the toner from the toner sensor 45, it is possible for the toner sensor 45 to erroneously determine that the developer container 40 is sufficient in the amount of toner therein, even when the developer container 40 is insufficient in the amount of the toner therein. Therefore, it is possible that the developer container 40 will be replenished with an insufficient amount of toner.

Figure 9:
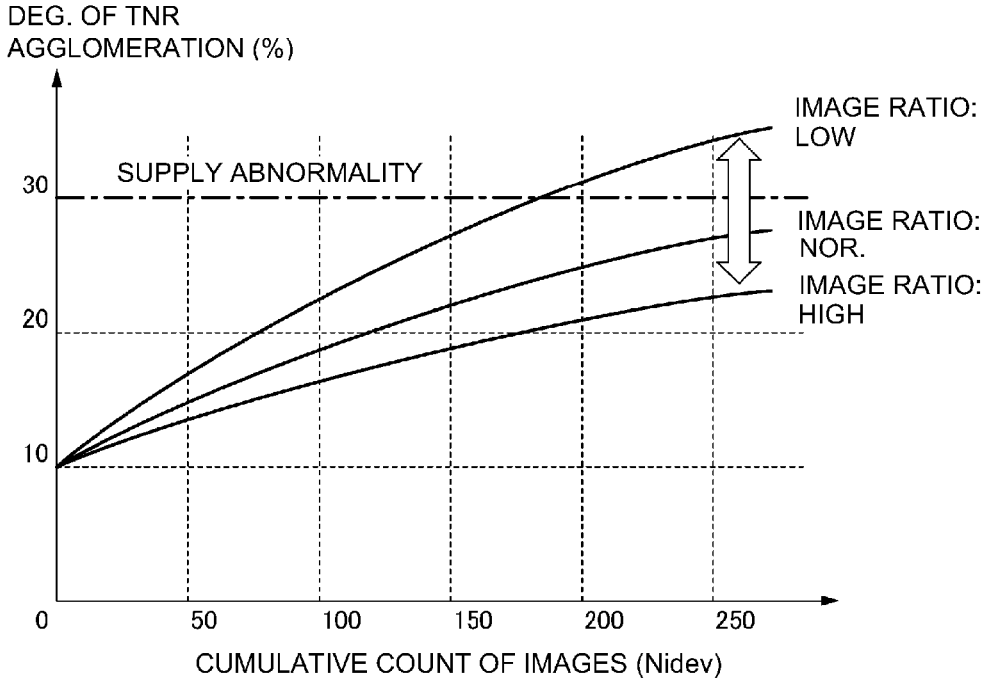
FIG. 9 is a drawing which shows the relationship between image ratio and degree of toner agglomeration.

Thus, it is proposed, in the Japanese Laid-open Patent Application No. 2004-206018, to change the threshold value for the toner sensor according to the increase in the cumulative number (Nidev) of the image formations, in order to prevent the amount of the toner in the developer container 40 from becoming excessive. This method, however, is problematic in that as the developer remains for a long time in the developer container 40, it deteriorates, increasing thereby in degree of agglomeration. For example, in a case where the image forming apparatus disclosed in Japanese Laid-open Patent Application No. 2004-206018 was used to continuously form a substantial number of images which were low in image ratio, the developer in the developer container 40 sometimes increased in degree of agglomeration to an abnormal level, as shown in FIG. 9.

<Degree of Agglomeration>

At this time, "degree of agglomeration" is described. It is an index which shows how easily particles (toner particles) agglomerate. It is thought that one of the reasons why the toner in the developer container 40 increases in degree of agglomeration is that as the toner in the developer container 40 is subjected to mechanical stress by the toner bearing member 41 and stirring-conveying member 44, the fluidization agent is buried into toner particles. Degree of agglomeration can be measured with the use of the following method.

The apparatus used in this embodiment to measure toner in degree of agglomeration was Powder Tester PT-D (commercial name: product of Hosokawa Micron Co., Ltd.). The degree of agglomeration of toner is measured as follows. First, three sieves which are different in mesh size are vertically stacked on the vibration plate of the measuring apparatus. Listing from the top side, the three sieves are 200, 390 and 635, which are 75 μm, 38 μm and 25 μm, respectively, in mesh size. Then, 5 g of such toner that was aged one night in an environment which was 23° C. in temperature and 50% in humidity was placed on the top sieve, and such vibrations that were 0.6 mm in amplitude was given to the vibration plate for 15 seconds. Then, the toner remaining on each sieve was measured in quantity (amount, unit of mass). Then, the degree of agglomeration of the toner is calculated with the use of the following equation:

$$\text{Degree of agglomeration}=(a)+(b)+(c)$$

wherein (a) stands for the amount (%) of the toner remaining on the sieve which is 75 μm in mesh size, (b) stands for the amount (%) of the toner remaining on the sieve which is 38 μm in mesh size, and (c) stands for the amount (%) of the toner remaining on the sieve which is 25 μm in mesh size.

It is evident from the studies made by the inventors of the present invention that it is when the toner in the developer container 40 is no less than 30% in degree of agglomeration that the developer container 40 is likely to be abnormally replenished with toner.

Figure 10:
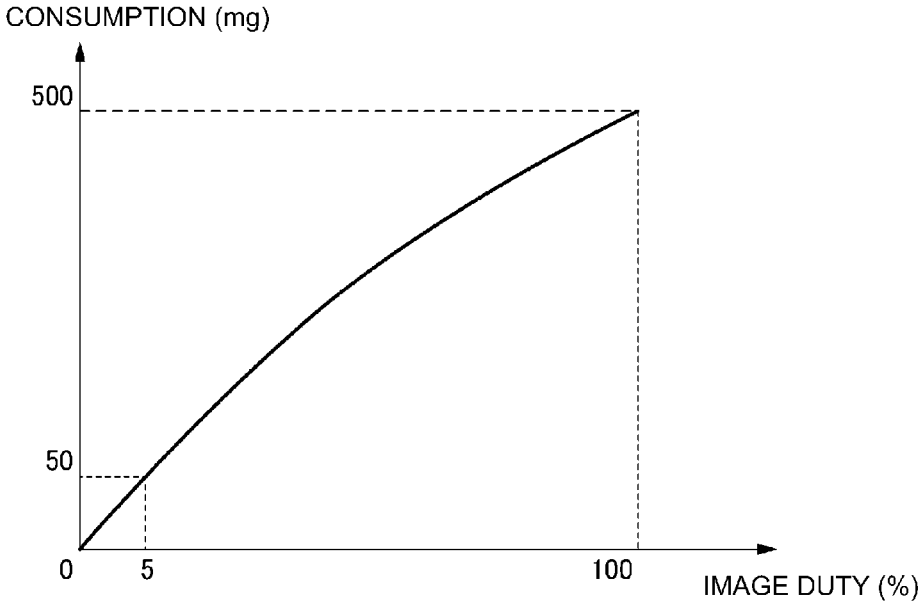
FIG. 10 is a drawing which shows the relationship between image duty and amount of toner consumption.
Figure 11:
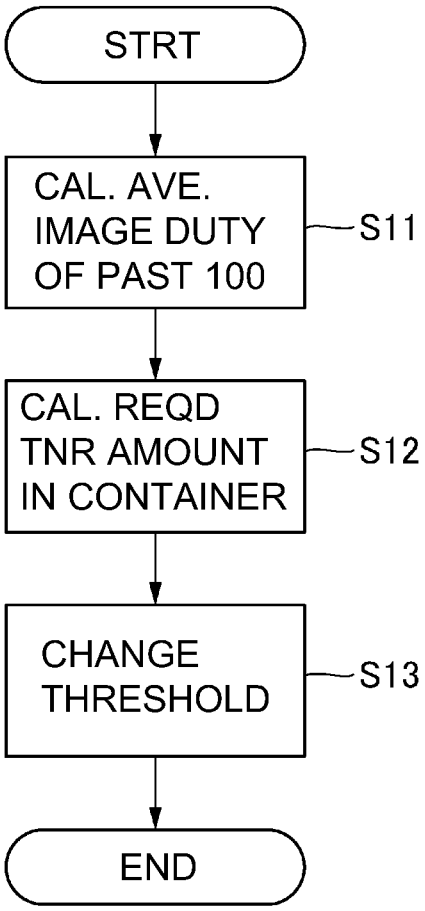
FIG. 11 is a flowchart of the operational sequence for changing the threshold value for the toner sensor, in the first embodiment.

Next, the length of time it takes for the toner in the developer container 40 to be completely replaced by a fresh supply of toner is described. FIG. 10 shows the amount by which toner is consumed by the formation of an image, and the image duty (image ratio) of the image. Generally speaking, in the case of an electrophotographic image forming apparatus, the graph which shows this relationship tends to have a small amount of upward curvature as shown in FIG. 10. Here, "image duty" means the ratio of the area(s) of the surface of a sheet of recording medium of size A4 covered with toner, relative to the entire area of the surface of the sheet of recording medium. Thus, when there is no image (no toner) on a sheet of recording medium of size A4, the image duty" is 0%, whereas when a sheet of recording medium of size A4 is entirely covered with toner (solid black image), the "image ratio" is 100%. The image duty of an ordinary document printed on a sheet of recording medium of size A4 is roughly 5%. The amount by which toner is consumed by the image forming apparatus 100 in this embodiment to print one page of ordinary document which is 5% in image duty is 50 mg. The toner consumption per minute is 5 g (500 mg×100 pages/min), and the amount of the toner in the developer container 40 is 250 g. Therefore, if it is assumed that the toner particles are consumed in the order in which they are delivered to the developer container 40, the length of time it takes for the toner in the developer container 40 to be entirely replaced by a fresh supply of toner when the image duty is 5% is 50 min (250 g÷5/min).

However, in a case where the image duty is 1%, the amount of toner consumption per page is roughly ⅕ (10 mg) of the amount by which toner is consumed in a case where the image duty is 5%. Therefore, the length of time it takes for the toner in the developer container 40 to be completely replaced with a fresh supply of toner is 250 min (50 min×5). That is, saying that it takes a long time for the toner in the developer container 40 to be completely replaced with a fresh supply of toner is the same as saying that the toner in the developer container 40 remains in the developer container 40 for a long time. The greater the length of time the toner in the developer container 40 remains in the developer container 40, the greater the length of time the toner in the developer container 40 is subjected to mechanical stress by the toner bearing member 41 and stirring-conveying member 44, and therefore, the more likely for the toner to increase in degree of agglomeration. Therefore, if it is possible to know the amount (ηP) of image duty, it is possible to estimate the length of time the toner in the developer container 40 remains in the developer container 40. Then, the degree of agglomeration of the toner in the developer container 40, which indicates the degree of deterioration of the toner in the developer container 40, can be estimated based on the estimated length of time the toner will remain in the developer container 40.

<Means to Prevent Toner from Increasing in Degree of Agglomeration>

In this embodiment, therefore, the image forming apparatus 100 is designed to make as short as possible, the length of time the toner remains in the developer container 40, in order to minimize the toner in the developer container 40, in the increase in degree of agglomeration. Next, referring to FIGS. 11-14 along with FIG. 4, the structural arrangement, in this embodiment, for preventing the toner in the developer container 40 from increasing in degree of agglomeration is described.

In this embodiment, the image forming apparatus 100 is structured so that the control device 81 controls the toner replenishment roller 93 to change developer container 40 in the amount of the developer therein, according to the degree of deterioration of the toner (developer) in the developer container 40. More concretely, the control device 81 obtains the average image ratio of a preset number of images to be formed, as a value related to the amount by which developer is used for a preset length of time during an image forming operation. Then, the control device 81 controls the toner replenishment roller 93 (controls operation for replenishing developer container with toner) so that if the average image ratio has the first value, the amount of the toner in the developer container 40 has the first value. On the other hand, if the average image ratio is smaller than the second value, which is smaller than the first value, the control device 81 controls the toner replenishment roller 93 so that the amount of the toner in the developer container 40 has the second value which is smaller than the first value.

More concretely, first, the average amount (average image duty) by which toner was consumed per sheet of recording medium while 100 pages (preset number of pages, preset length of time) of image were formed in the immediately preceding image forming operation, as will be described next (S11). In this embodiment, the entire picture elements on each page are counted with the use of a pixel counter, which is a device for counting picture elements (FIG. 4). Then, the image duty (ηP) of the page is calculated with the use of an image ratio calculation program, which the control device 81 has. That is, the control device 81 obtains the image duty (ηP) by dividing the pixel count CP of each page by the total pixel count (Cmax) of a page, the entirety of which is covered with FFH picture elements, and converting the obtained quotient into decimal percentage. Then, the control device 81 stores the image duty (ηP) of each of 100 pages of image obtained as described above in a memory 84 (FIG. 4). Then, it calculates the average image duty (ηPaver=average image ratio).

Next, the control device 81 calculates (estimates) the amount of toner which the developer container 40 requires, based on the average image duty (ηPave) per page obtained from 100 pages of image formed in the immediately preceding operation (S12). The memory 84 has a table, such as the one shown in FIG. 12, which shows the relationship between the image duty and the amount of toner which the developer container 40 requires. It is based on this table that the control device 81 calculates the amount of toner which the developer container 40 requires.

The contents of this table, that is, the relationship between the image duty and the amount of toner which the developer container 40 requires, is obtained in advance based on the following standpoint. To begin with, in a case where images which are high in image duty (solid black page; image which is 100% in image duty) are continuously outputted, a sufficient amount of toner has be present on the back side of the toner bearing member 41. Here, the "back side" of the toner bearing member 41 means the opposite side of the toner bearing member 41 from the photosensitive drum 1, where the developer in the developer container 40 is borne by the toner bearing member 41. In the case of an image forming operation in which images which are high in duty are continuously outputted, unless a sufficient amount of toner is present on the back side of the toner bearing member 41, the amount by which toner is borne by the toner bearing member 41 cannot catch up with the amount by which toner is consumed, which results in the occurrence of such a phenomenon that the image forming apparatus 100 outputs images which suffer from unwanted white spots. In order to prevent the image forming apparatus 100 in this embodiment from outputting solid black pages which do not have white spots, there has to be 250 g of toner in the developer container 40.

On the other hand, when an image which is low in image duty is formed, the developer container 40 does not require the same amount of toner as when an image which is high in duty is formed. In particular, the amount of the toner which the developer container 40 is required to have when the image to be formed is low in duty has only to be large enough for a part of the toner bearing member 41 to be in contact with the toner in the developer container 40. A sufficient amount of toner which the developer container 40 of the image forming apparatus 100 in this embodiment is required to have when the image forming apparatus 100 is used to output an image which is 1% in duty is 150 g.

Figure 13:
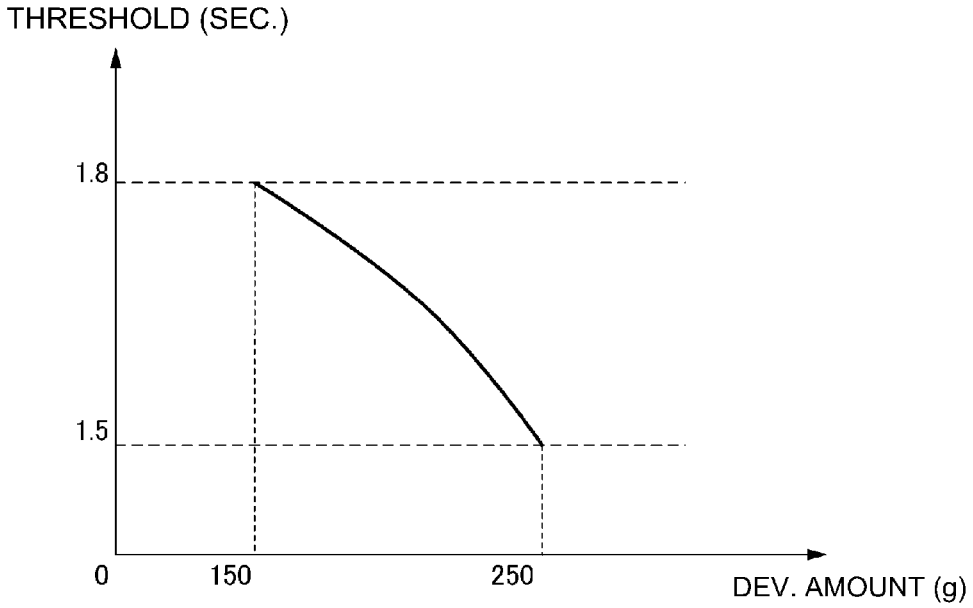
FIG. 13 is a drawing which shows the relationship between the amount of developer in the developer container, and the threshold value for the toner sensor, in the first embodiment.

Next, the threshold values for the toner sensor 45 are calculated from the estimated amount of toner which the developer container 40 has to contain (S13). The graph in FIG. 13 shows the relationship between the amount of the toner in the developer container 40 and the replenishment threshold value (threshold value TLt for low voltage period) for the toner sensor 45. For example, in a case where the amount of the toner in the developer container 40 is 250 g (first value), that is, when preceding 100 images are 100% (first image ratio) in average duty, the control device 81 begins to replenish the developer container 40 with replenishment toner (developer) if the low voltage period (TL) lasts no less than 1.5 seconds. That is, the threshold value for the low voltage period is set to 1.5 s (first threshold value).

On the other hand, in a case where the amount of toner in the developer container 40 is 150 g (second value), that is, in a case where the preceding 100 images are 1% (second image ratio) in average duty, the control device 81 does not begin replenishing the developer container 40 with toner (developer) unless the low voltage period lasts no less than 1.8 seconds. That is, the control device 81 sets the threshold value for the length TLt of low voltage period to 1.8 seconds (second value) which is larger than the first threshold value. By setting higher the replenishment threshold value for the toner sensor 45 when the average image duty is low than when the average image duty is high, as described above, it is possible to reduce the amount of the toner which is in the developer container 40 when the average image duty, compared to the amount of the toner which is in the developer container 40 when the average image duty is high.

As described above, in this embodiment, the control device 81 estimates the state of deterioration (length of time toner remained in developer container 40) of the toner in the developer container 40, based on the average duty of a preset number of preceding images, and then, changes the amount of toner in the developer container 40, based on the estimated state of deterioration, in order to prevent the toner in the developer container 40 from increasing in degree of agglomeration. That is, according to the design of the image forming apparatus 100 in this embodiment, even if the apparatus 100 is operated in an environment in which toner tends to deteriorate, it can prevent the toner in the developer container 40 from increasing in degree of agglomeration, by reducing the length of time it takes for the toner in the developer container 40 to be entirely replaced by a fresh supply of toner.

More concretely, in the case of the conventional design for an electrophotographic image forming apparatus, if preceding images were 1% in average image duty, it took 250 minutes (250 g÷1 g/min) for the toner in the developer container 40 to be completely replaced by a fresh supply of toner. In comparison, in this embodiment, it was no more than 150 minutes (150 g÷1 g/min). Thus, in the case of a conventional image forming apparatus, when the average image duty was 1%, the toner in the developer container 40 increased in degree of agglomeration by as high as 30%, whereas in the case of the image forming apparatus 100 in this embodiment, the toner in the developer container 40 remained no more than 26% in degree of agglomeration. In other words, this embodiment made it possible to keep the toner in the developer container 40 no higher than 30% in degree of agglomeration.

By the way, in this embodiment, only means used to control the amount of toner in the developer container 40 was to change the threshold value set for the duration of the period in which the voltage detected by the toner sensor 45 remains below a preset threshold value. However, the image forming apparatus 100 may be designed so that the amount of the toner in the developer container 40 is changed by changing the threshold value for the duration of the high voltage period. Further, in this embodiment, a sensor having a piezoelectric element was used as the toner sensor 45. However, the sensor for detecting the developer in the developer container 40 may be an optical sensor, which detects the developer by projecting a beam of light upon the developer in the developer container 40 and detecting the amount by which the beam is reflected by the developer, or an inductance sensor, for example. Regardless of sensor choice, the amount of toner in the developer container 40 is changed according to the estimated degree of deterioration of the toner in the developer container 40, by changing the threshold value for the toner sensor 45 according to the average duty of a preset number (100, for example) of preceding images.

Further, in this embodiment, the average image duty of preceding 100 images was used to estimate the state of deterioration of the toner in the developer container 40. However, the image count (number of preceding image) is optional. It is to be set according to the amount of toner in the developer container 40, toner properties in terms of agglomeration, and/or the like factor.

Further, in this embodiment, the average image duty of a preset number of preceding images was used as the value related to the amount by which developer was used for image formation per preset length of time. However, the cumulative length of time the developing device 4 (toner bearing member 41) has been driven, cumulative pixel count or average pixel count of the preset number of the preceding images, or the like factor may be used instead of the average image duty of the preset number of preceding images. For example, the image forming apparatus 100 may be designed so that it calculates the cumulative or average pixel count of a preset number of preceding images; if the pixel count has the first value, its control device 81 controls the developing device 4 so that the amount of toner in the developer container 40 takes the first value; if the pixel count takes the second value, the control device 81 controls the developing device 4 so that the amount of toner in the developer container 40 takes the second value.

Embodiment 2

Figure 15:
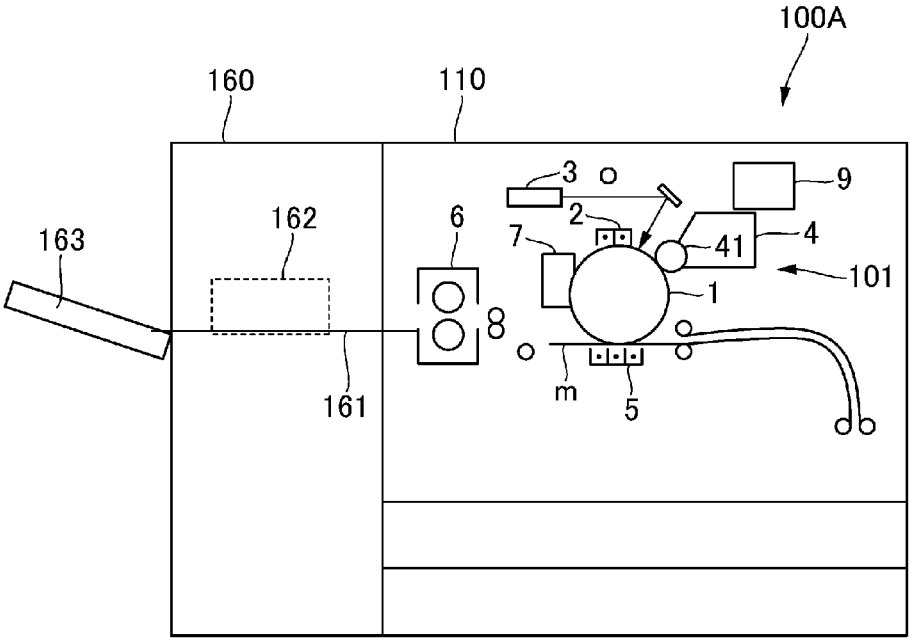
FIG. 15 is a schematic sectional view of the image forming apparatus in the second embodiment of the present invention, and is for describing the structure of the apparatus.

Next, referring to FIG. 15, the second embodiment of the present invention is described. It sometimes occurs that while images are continuously formed on sheets of recording medium, one for one, the sheet interval is increased. That is, the image forming apparatus 100A in this embodiment is designed so that as a certain condition is met, the sheet interval can be made greater than when the condition is not met. For example, in a case where recording medium for image formation is switched from a sheet of thin paper to a sheet of cardstock, an image forming apparatus is sometimes increased in sheet interval. Further, in a case where a sheet and the image thereon are subjected to a certain process after the fixation of the image to the sheet, the image forming apparatus is sometimes increased in sheet interval. This embodiment is described regarding the control to be executed when the image forming apparatus is increased in sheet interval. The image forming apparatus in this embodiment is the same in basic structure as the one in the first embodiment. Therefore, portions of the image forming apparatus in this embodiment, which are similar in structure to the counterparts of the image forming apparatus in the first embodiment, are given the same referential codes, one for one, as the counterparts, and are not described in detail here. Next, the second embodiment of the present invention is described about the portions of the second embodiment, which are different from the counterparts in the first embodiment.

The image forming apparatus 100A in this embodiment has: a photosensitive drum 1, a primary charging device 2, a laser scanner 3, a developing device 4, a transferring device 5, a fixing device 6, a cleaning device 7, a toner replenishment device 9, etc. It is equipped with an image forming portion 101 for forming an image on a sheet of recording medium. Each of the various portions of the image forming portion 101 is similar in structure to the counterpart in the first embodiment. Further, the image forming apparatus 100A is provided with a processing device 160, in addition to the image forming portion 101. The processing device 160 temporarily interrupts the image forming operation which is being carried out by the image forming portion 101, and subjects a sheet, on which an image has just been formed in the image forming portion 101, to a preset process. More concretely, the processing device 160 is in connection to the main assembly of the image forming apparatus 100A, in which the image forming portion 101 is located. As a sheet of recording medium is discharged from the main assembly 110 of the image forming apparatus 100A, the processing device 160 catches the sheet, and subjects the sheet to the preset process, such as sorting, stapling, punching, folding, etc. Thus, the preset condition to be satisfied is that the sheet interval is long enough for the process to be carried out by the processing device 160. Therefore, in a case where the sheets are to be subjected to stapling or the like process after the image formation thereon, the image forming apparatus 100A is increased in sheet interval, compared to when it is unnecessary for the sheets to be subjected to a preset process after the image formation (normal image forming operation: image forming operation which is not succeeded by process to be carried out by processing device 160).

Next, an example of a process which is carried out by the processing device 160 in response to a command issued to staple every five sheets of recording medium as a set, to provide three sets of sheets of recording medium, is described. After the formation of an image on a sheet m of recording medium in the image forming portion 101, the sheet m is delivered to the processing device 160 through a sheet conveyance passage 161. Then, the sheet m is stored in a buffer portion 162 of the processing device 160. As five sheets m accumulate in the buffer portion 162, they are stapled together by an unshown stapler. Then, they are sent to a discharging portion 163.

Generally speaking, the sheet interval set for an ordinary image forming operation is not long enough for stapling. In this embodiment, the length of time necessary for stapling is 500 msec, whereas the ordinary sheet interval is 180 msec. By the way, the image forming apparatus 100A in this embodiment can continuously form images at a process speed of 500 mm/sec (100 page/min) like the image forming apparatus 100 in the first embodiment. In terms of the sheet conveyance direction, the dimension of a sheet m of recording medium of size A4 is 210 mm. Therefore, the ordinary sheet interval is 180 msec (=0.18 sec=(500 mm/sec×60 sec/min÷100 page/min−210 mm/page)÷500 mm/sec).

Therefore, after the control device 81 makes the image forming apparatus 100A form five images, it delays the starting of the formation of the next image by 320 msec (=500 msec−180 msec). That is, after the formation of five images by the image forming portion 101, the control device 81 makes the image forming portion 101 temporarily stop image formation, and then, it makes the image forming portion 101 restart image formation after the elapse of 320 msec. In other words, after the formation of the fifth image, the control device 81 extends the sheet interval by 320 msec (adjusts image forming portion 101 in timing with which image is formed on sixth sheet m), in order to prevent the sixth sheet m of recording medium from entering the buffer portion 162 while the preceding five sheets m are processed. Similarly, the control device 81 extends the sheet interval after the formation of the tenth image, to delay the formation of the eleventh image, so that three stapled sets of prints can be completed without paper jams.

However, the developing device 4 is continuously driven even during the sheet interval extended by 320 msec for stapling. Therefore, during the extended sheet interval, the toner in the developer container 40 is subjected to a greater amount of mechanical stress by the toner bearing member 41 and stirring-conveying member 44 than during the normal sheet interval. That is, during the extended sheet interval, the toner in the developer container 40 is more likely to deteriorate, and therefore, more likely to increase in degree of agglomeration, than during the normal sheet interval.

By the way, it is possible not to drive the developing device 4 during the extended sheet interval, in order to prevent the toner deterioration. However, if an image is formed immediately after the driving of the developing device 4 is restarted, the resultant image sometimes suffers from an image defect which is attributable to the portion of the toner layer on the toner bearing member 41, which was formed when the driving of the developing device 4 was stopped, or restarted. Thus, in order to make the toner layer on the toner bearing member 41 uniform in thickness after the restarting the driving of the toner bearing member 41, the toner bearing member 41 has to be rotated 2-3 seconds before the image formation is restarted. Besides, temporarily halting the driving of the developing device 4 during the sheet interval adds to the waiting time, and also, accelerates toner deterioration. In this embodiment, therefore, in a case where the length in time of the sheet interval is not excessively long, the driving of the developing device 4 is not halted during the sheet interval. That is, if the abovementioned sheet interval is 320 msec, the driving of the developing device 4 is continued.

In the case of the above-described job, the developing device 4 is continuously driven even during the sheet interval which occurs after the formation of the fifth image, and the sheet interval which occurs after the formation of the tenth image. Therefore, even if the image to be formed on a sheet of recording medium of size A4 is 2% in image duty, the amount by which toner is consumed during these extended sheet intervals is equivalent to the amount of toner consumed at the rate of 297 mm×4.2 mm for 920 ms. Here, the length in time necessary for each sheet of recording medium of size A4, that is, the length of time the developing device 4 has to be driven for each sheet, in an image forming operation for continuously forming images at a process speed of 100 page/min, is 600 msec. The length in time by which the abovementioned sheet intervals are extended is 320 msec is described above. Therefore, the length in time the developing device 4 is driven during the sheet interval which occurs between the completion of the fifth image and the starting of the sixth image is 920 msec, which is the sum of the length of the normal sheet interval and the length of time by which the sheet interval is extended (for stapling). On the other hand, in terms of the direction parallel to the sheet conveyance direction, a sheet of recording medium of size A4 is 210 mm in length, whereas in terms of the direction perpendicular to the sheet conveyance direction, it is 297 mm. Therefore, the length of an image which is 2% in image ratio, relative to a sheet of size A4 is equivalent to 4.2 mm (210 mm×2%), and its size is 4.2 mm×297 mm. Therefore, the toner in the developer container 40 is consumed by an amount equivalent to 4.2 mm×297 mm, during the sum of the length of time necessary to form the fifth image, and the length of time provided for stapling.

As described above, even during a sheet interval, the toner in the developer container 40 is made to deteriorate by the rotation of the toner bearing member 41 and stirring-conveying member 44. Therefore, in a case where the sheet interval is changed in length in time as in this embodiment, or in a case where the length in time the developing device 4 is driven while no image is formed is unignorable from the standpoint of toner deterioration, it is desirable that degree of deterioration of the toner in the developer container 40 is estimated in consideration of this length of time the developing device 4 is driven while no image is formed. More concretely, it is desired that the degree of deterioration of the toner in the developer container 40 is estimated based on the average image ratio (average image duty; amount of toner consumption) per unit length of time while the developing device 4 (toner bearing member 41 and stirring-conveying member 44) is driven.

In this embodiment, therefore, the sum of the length of time necessary to form an image on a preset number of sheets of recording medium when the preset condition is not met, and the length in time by which the sheet interval is extended, is used as the value (length of time) used to calculate the average image duty. That is, the sum of the length of time necessary to form a preset number of images, and the length of time by which the sheet interval has to be extended for stapling is used as the preset value (length of time) necessary for forming the preset number of images. Then, the state of the toner in the developer container 40, in terms of deterioration, is estimated based on the average image ratio (Duty) per unit length of time while the developing device 4 is driven during this period.

In this embodiment, the length of time necessary to form five images is 3,320 msec (600 msec×5+320 sec), and the length of the normal sheet interval, that is, the sheet interval in which sheets are not stapled, is 3000 msec. Therefore, in a case where five images which are 2% in image duty are formed, and then, sheets are stapled together, the average image duty of the five images is equivalent to 1.8% (2%×3000 msec÷3320 msec).

As described above, in this embodiment, the product of the length of time the developing device 4 is driven, and pixel count, is converted into average picture duty per unit length of time. Then, the amount of the toner which is required by the developer container 40 is calculated based on the average picture duty calculated as described above. Thus, not only is it possible to prevent the toner in the developer container 40 from increasing in degree of agglomeration due to the change in image duty, but also, due to the change in the length of job (length of time developing device 4 is driven).

Figure 14:
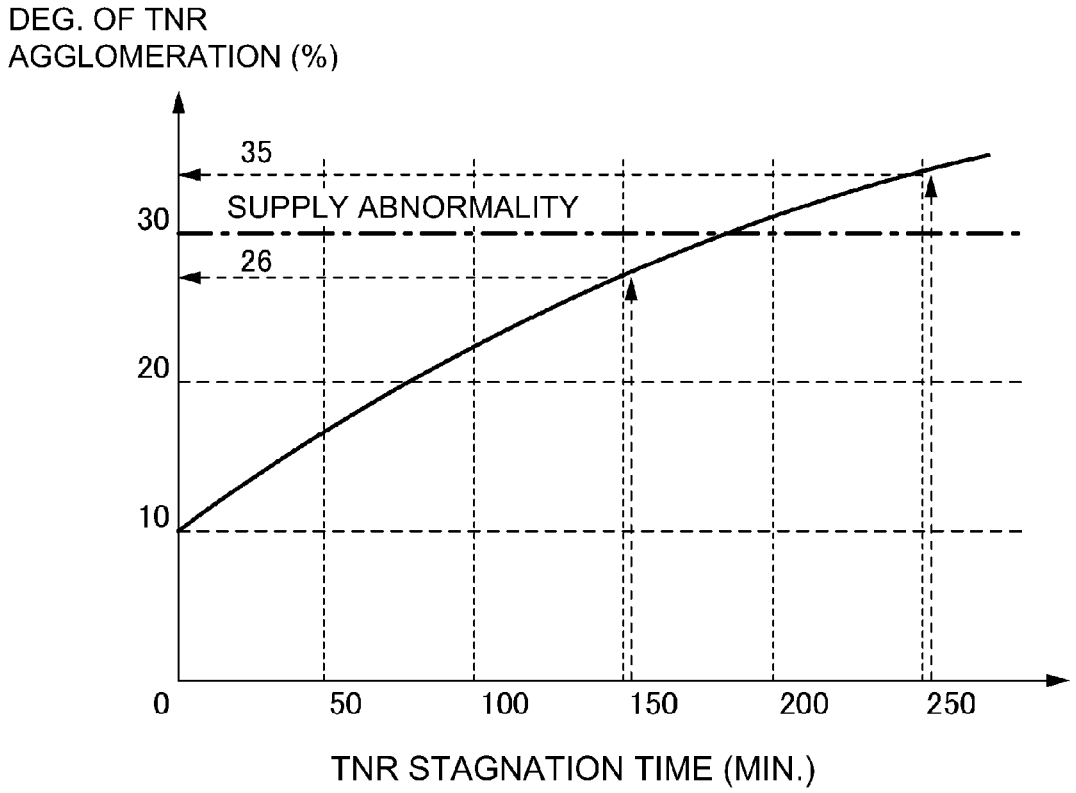
FIG. 14 is a drawing which shows the relationship between the length of time developer has been remaining in the developer container, and the degree of toner agglomeration.

More concretely, an ordinary print is 2.0% in image duty. Therefore, if it is based on only the image duty per sheet (image), as in the first embodiment, that the amount of the toner in the developer container 40 is controlled, the estimated amount of toner which the developing device 4 requires is 180 g. Since the amount of toner consumption per sheet is 1.6 g, it takes 112.5 min for the toner in the developer container 40 to be entirely replaced by a fresh supply of toner. In this case, the degree of deterioration of the toner in the developer container 40 was 22% (FIG. 14). In comparison, if the developing device 4 is controlled as if the average image duty per unit length of time were 1.8% as in this embodiment, the estimated necessary amount of toner is 170 g. Thus, it is 106 min for the toner in the developer container 40 to be entirely replaced with a fresh supply of toner. That is, it is possible to reduce the degree of agglomeration to 21%.

As described above, as long as the degree of agglomeration is no more than 30%, it is possible to prevent the developer container 40 from being abnormally replenished with toner. However, in a case where the amount of the toner in the developer container 40 is reduced, the toner deteriorates while it remains in the developer container 40 to be consumed for image formation. For example, assuming here that if the image duty is high, the amount of the toner in the developer container 40 is increased, and then, is reduced as the image duty reduces. In this case, the amount of the toner in the developer container 40 reduces as the toner is consumed by image formation. However, if a large amount of toner is in the developer container 40, it takes a substantial length of time for the amount of the toner in the developer container 40 to reduce. The toner in the developer container 40 continues to deteriorate while the amount of the toner in the developer container 40 reduces. Therefore, it is desired that the amount of the developer container 40 is always kept as small as possible. This is why the image forming apparatus 100A in this embodiment is controlled to keep the amount of the toner in the developer container 40 as small as possible as described above.

In this embodiment, the image forming apparatus 100A was controlled so that the length of time required for stapling was taken into consideration. However, an image forming apparatus may be structured so that the length of time necessary for other processes to be carried out by the processing device 160 is taken into consideration. For example, in a case where the image forming apparatus 100A is a copying machine designed so that the speed at which it reads multiple originals is slower than the speed at which it outputs multiple copies, the apparatus 100A may be designed so that the length of time it takes for the apparatus 100A to read the originals is taken into consideration. Further, it may be designed so that it takes into consideration, the length of time necessary for a preparatory operation, such as the length in time of the sheet interval which occurs between the two consecutively conveyed sheets when a printing job for forming multiples images is sent to the apparatus 100A from a peripheral device.

Further, in the foregoing, the calculation was related to only the changes in the length in time of sheet interval. However, it is desired that an image forming apparatus is designed so that it takes into consideration not only the image duty of the images which a user intends to output, but also, the image duty of test images (test patches) formed to adjust the apparatus in image tone.

Embodiment 3

Figure 16:
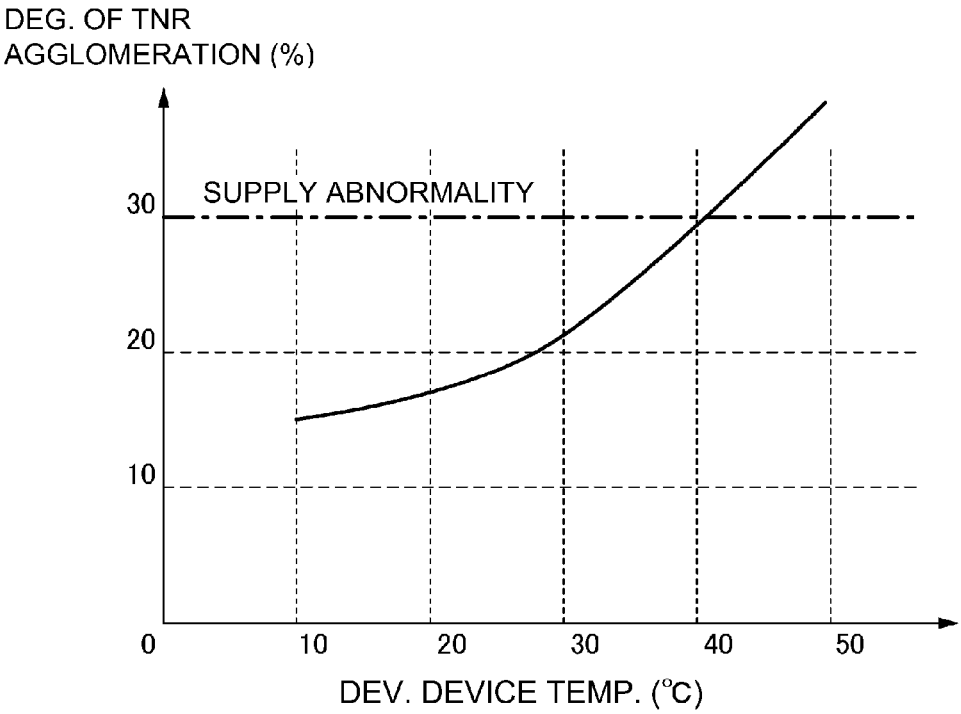
FIG. 16 is a drawing which shows the relationship between the temperature of the developing device and the degree of toner agglomeration, in the third embodiment of the present invention.
Figure 17:
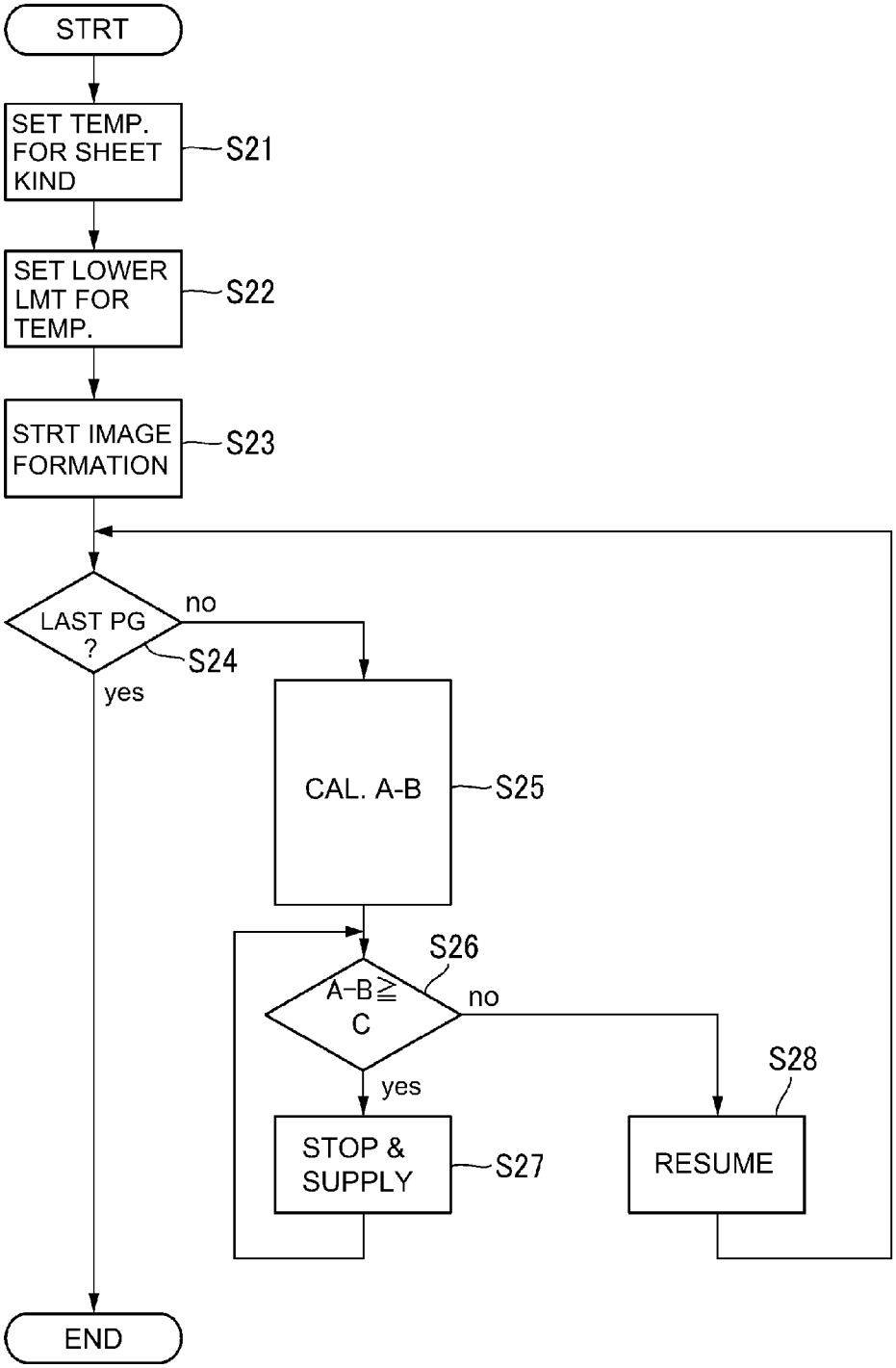
FIG. 17 is a flowchart of the control sequence for replenishing the developer container with a fresh supply of toner, in the third embodiment.
Figure 18:
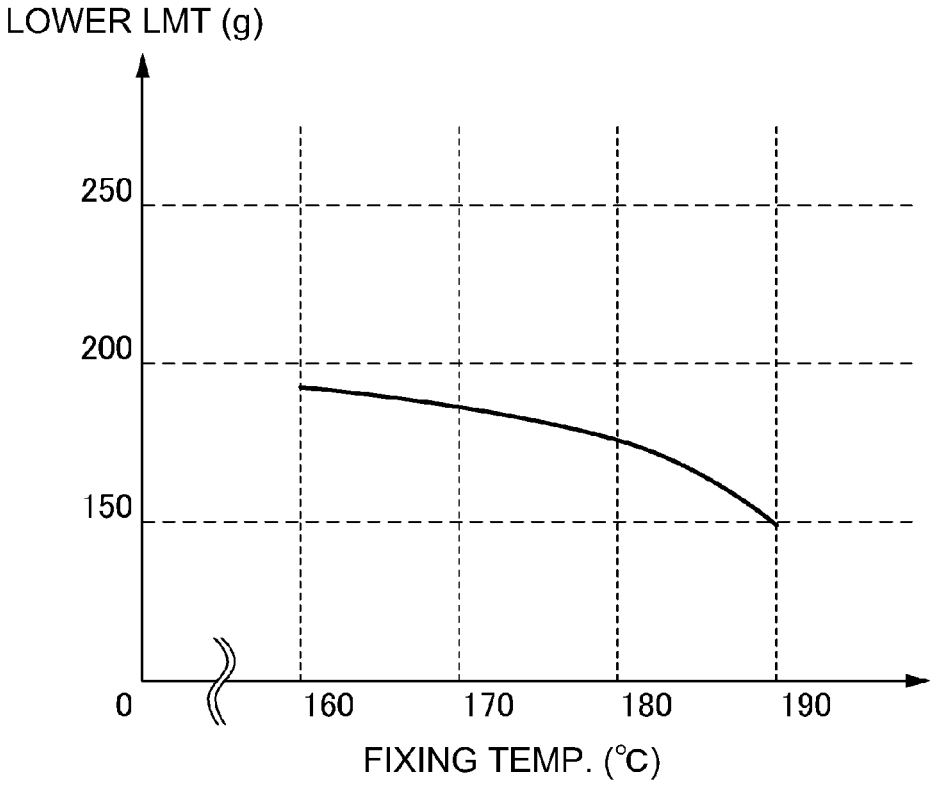
FIG. 18 is a drawing which shows the relationship between the level to which the temperature of the fixing device is set, and the smallest amount of toner required in the developer container, in the third embodiment.

Next, referring to FIGS. 16-18 along with FIGS. 1-4, the third embodiment of the present invention is described. In this embodiment, the image forming apparatus 100 is designed so that the developing device 4 is controlled in the amount of the toner in the developer container 40 according to the condition of the fixing device 6. Otherwise, the image forming apparatus 100 in this embodiment is similar in structure and function to the image forming apparatus 100 in the first embodiment. Thus, the portions of the image forming apparatus 100 in this embodiment, which are similar in structure to the counterparts in the first embodiment, are given the same referential codes as those given to the counterparts, and are not described in detail here. That is, the description of this embodiment is aimed at the difference between the third and first embodiments.

The image forming apparatus 100 in this embodiment is enabled to deal with a wide range of recording medium (sheet m). In terms of basis weight, it can deal with a wide range of recording media, ranging from ordinary paper which is 50 g/m$^2$ to coated paper which is 300 g/m$^2$ in basis weight, for example. In terms of surface properties, it can also deal with a wide range of recording media, ranging from those which are high in flatness to those which are low in flatness. In order to deal with the wide range of recording media, the image forming apparatus 100 controls the condition under which the fixing device 6 is operated. The most commonly controlled operational condition for the fixing device 6 is temperature.

For example, referring to FIG. 1, the fixing device 6 has a heat roller 6*a* and a pressure roller 6*b*, which form a nip between themselves. It fixes the unfixed toner image on a sheet of recording medium to the sheet, by heating and pressing the sheet and the toner image thereon while it conveys the sheet through the nip. More specifically, it makes the surface of the sheet, on which the unfixed toner image is present, contact the heat roller 6*a*, while keeping the temperature of the heat roller 6*a* at a present level by controlling the heater, with which the developing device 4 is provided to heat the heat roller 6*a*. In order to heat the sheet at a temperature level which is suitable for the sheet, the heat roller 6*a* is changed in temperature. More specifically, when the basis weight of a sheet of recording medium has the first value, the temperature of the heat roller 6*a* is set to the first level, whereas when the basis weight of the sheet has the second value which is greater than the first value, the temperature of the heat roller 6*a* is set to the second level which is higher than the first level. By the way, in some cases, the pressure roller 6*b* also is provided with a heater, which also is changed in temperature according to the basis weight of the sheet. Next, a case in which the heat roller 6*a* is changed in temperature is described.

In this embodiment, the heat roller 6*a* is controlled in temperature according to the basis weight of a sheet of recording medium. More specifically, in a case where the recording medium is a sheet of thin paper, the temperature of the heat roller 6*a* is set to 160° C.; in a case where the recording medium is a sheet of ordinary paper, it is set to 170° C.; and in a case where the recording medium is a sheet of cardstock, the temperature of the heat roller 6*a* is set to 190° C. This control is executed, because, if the amount of the heat given to the sheet of recording medium is too small, the phenomenon which is referred to as "under fixation", that is, a phenomenon that toner fail to be fixed to the sheet m, will occur, whereas if the amount of heat given to the sheet is too much, the phenomenon which is referred to as "fixation offset", that is, a phenomenon that a certain amount of toner particles in the toner image on the sheet m remains on the side of the fixing device, will occur. Therefore, the temperature of the heat roller 6*a* is set to a proper level according to the type of the sheet m, in order to prevent the under fixation or fixation offset.

By the way, the longer the length of time the toner in the developer container 40 is subjected to heat, the faster the speed with which the toner increases in degree of agglomeration, and the higher the toner becomes in degree of agglomeration. That is, as the fixing device 6 (heat roller 6*a*) increases in temperature, it increases in the amount by which it radiates heat, which in turn increases the internal temperature of the image forming apparatus 100, which in turn increases in temperature the toner in the developer container 40, making it more likely for the toner in the developer container 40 to increase in degree of agglomeration. As described previously, the reason why the toner in the developer container 40 agglomerates is that with the increase in ambient temperature, the particles of fluidizing agent are embedded into the toner particles. Thus, it is thought that as the toner in the developer container 40 increases in temperature, so does the speed with which the toner agglomerates. It has been confirmed by the studies made by the inventors of the present invention that if an image forming operation is continued while the amount of the toner in the developer container 40 is kept stable, the toner in the developer container 40 begins to exponentially increase in degree of agglomeration as the image formation count (Nidev) exceeds 250 as shown in FIG. 6, which shows the relationship between the temperature of the developing device 4 and the degree of agglomeration of toner.

In the case of the image forming apparatus 100 in this embodiment, as long as the amount of the toner in the developer container 40 is kept at 150 g, replenishment anomaly does not occur even if the temperature of the fixing device 6 is kept at 190° C., which is the temperature level for cardstock. In comparison, as long as the temperature of the fixing device 6 is kept at 160° C. which is for thin paper, even if the amount of the toner in the developer container 40 is 190 g, and the image duty is 1%, the degree of agglomeration of the toner increases no higher than 25%, and therefore, replenishment anomaly does not occur.

Figure 12:
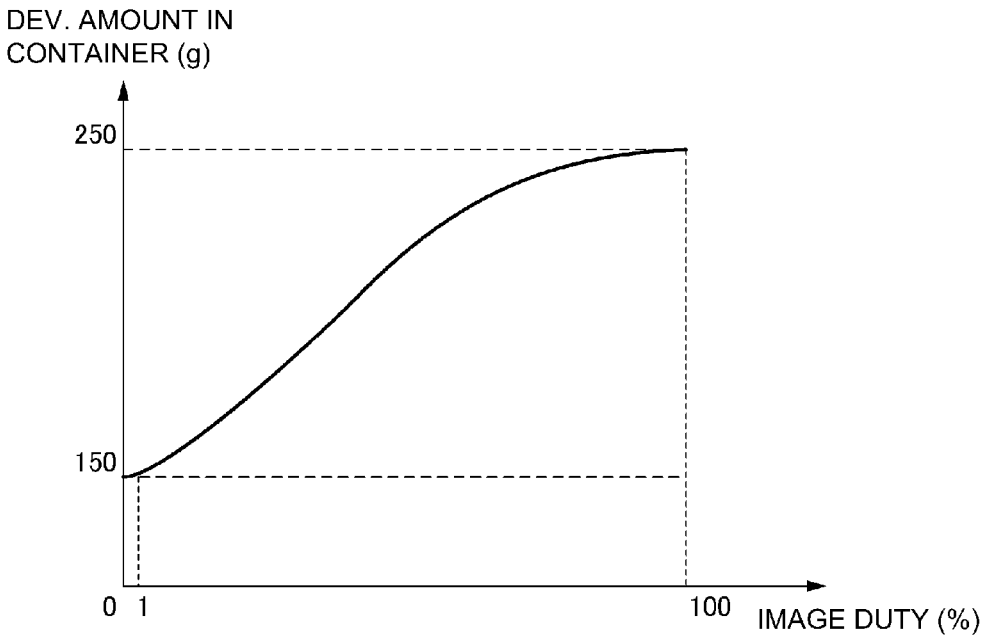
FIG. 12 is a drawing which shows the relationship between image duty and the amount of developer in the developer container.

Next, a case in which a user wants to continuously form a substantial number of images which are 1% in image duty, and then, form a substantial number of images which are 50% in image duty is described. Referring to FIG. 12, when the image duty is 1%, the amount of the toner in the developer container 40 has only to be 150 g. Thus, image formation is continued without replenishing the developer container 40 with toner, until the amount of the toner in the developer container 40 reduces to 150 g. If the average image duty of the preceding 100 sheets (images) is 1% when the amount of the toner in the developer container 40 reduced to 150 g, the control device 81 controls the image forming apparatus 100 with the use of a method as the one in the first embodiment to keep the amount of the toner in the developer container 40 at 150 g.

In comparison, in a case where the image duty is 50%, the amount of the toner in the developer container 40 needs to be no less than 220 g. Thus, if the amount of the toner in the developer container 40 is kept at 150 g, it is possible that the image forming apparatus 100 will output such images that have unwanted white spots. Therefore, the control device 81 stops the process of forming electrostatic latent images with the use of a laser, before the starting of the formation of images which are 50% in image duty. Then, it makes the image forming apparatus 100 replenish the developer container 40 with toner. The speed at which the developer container 40 is replenished with toner is 5 g per second. Therefore, it takes 14 seconds to replenish the developer container 40 with 70 g of toner. The control device 81 makes the image forming apparatus 100 restart the process for forming electrostatic latent images with the use of the laser, after the amount of the toner in the developer container 40 is made to reach the required value by the replenishment.

In the case of cardstock, it is impossible to reduce these 14 seconds of waiting period. However, in a case where the recording medium is thin paper and the image duty is 1%, the amount of the toner in the developer container 40 has only to be no less than 190 g. Therefore, the amount by which the developer container 40 is replenished with toner is only 30 g. Therefore, the length of time for the replenishment can be reduced to 6 seconds. In this embodiment, therefore, the control device 81 sets a bottom threshold value for the amount of the toner required in the developer container 40, according to the condition (temperature in this embodiment) for the fixing device 6, along with the image ratio.

That is, in a case where the temperature set for the heat roller 6*a* has the first value, the control device 81 sets the bottom threshold temperature for the toner in the developer container 40 to the first value. On the other hand, in a case where the temperature set for the heat roller 6*a* has the second value which is greater than the first value, the control device 81 sets the bottom threshold value for the amount of the toner in the developer container 40 to the second value which is smaller than the first value. For example, in a case where the recording medium is thin paper, the temperature for the heat roller 6*a* is set to 160° C. (first value), and the minimum amount for the toner in the developer container 40 is set to 190 g (second value), the temperature for the heat roller 6*a* is set to 190° C., and the bottom threshold value for the amount of the toner in the developer container 40 is set to 150 g (second value). Therefore, in a case where the recording medium is thin paper, the bottom threshold value for the amount of the toner in the developer container 40 is set to 190 g, even though, ordinarily, if the image duty is 1%, the bottom threshold value for the for the amount of the toner in the developer container 40 is set to 150 g. That is, even if the image duty is 1%, the image forming apparatus 100 is controlled so that the amount of the toner in the developer container 40 becomes 190 g.

Next, referring to FIG. 17 which is a flowchart, the operational sequence, in this embodiment, for controlling the amount of the toner in the developer container 40 is concretely described. First, the control device 81 sets the temperature (fixation temperature) for the fixing device 6 (heat roller 6*a*), according to the type of the sheet m selected by a user for the image forming apparatus 100 (S21). If the selected recording medium is thin paper, the control device 81 sets the fixation temperature to 160° C., whereas if the selected recording medium is cardstock, the control device 81 sets the fixation temperature to 190° C. Then, the control device 81 sets the bottom threshold value for the amount of the toner in the developer container 40, based on the chosen value for the fixation temperature (S22). This selection is made based on a table such as FIG. 18 which shows the relationship between the preset values for the fixation temperature of the heat roller 6*a*, and the preset values for the minimum amount of the toner for the developer container 40. This table was obtained through the studies made to find the effect of the temperature of the fixing device 6 (temperature set for heat roller 6*a*) upon the ambient temperature of the developing device 4. Then, based on the thus obtained values, the length of time, during which the degree of agglomeration of the toner in the developer container 40 is in a tolerable range (in which degree of agglomeration of toner in developer container 40 does not reach a level, at and beyond which the developer container 40 is abnormally replenished with toner) is obtained. In this embodiment, in a case where the temperature set for the heat roller 6*a* is 160° C. (for thin paper), the amount of the toner in the developer container 40 is 190° C., whereas in a case the temperature set for the heat roller 6*a* is 190° C. (for cardstock), the amount of the toner in the developer container 40 is 150 g.

As the bottom threshold value is set for the amount of the toner in the developer container 40, and the temperature of the fixing device 6 (heat roller 6*a*) reaches the set level, the control device 81 makes the image forming apparatus 100 start an image forming operation (S23). During the image forming operation, the control device 81 controls the process of replenishing the developer container 40 with toner, according to the average image duty, as in the first embodiment, in order to prevent the amount of the toner in the developer container 40 from falling below the bottom threshold value (minimum value) set for the amount of the toner in the developer container 40. Then, it determines whether or not the next page (image) is the last one (S24). If the next page is the last one, the control device 81 stops replenishing the developer container 40 with toner.

If the next page is not the last one in S24, the control device 81 calculates the difference (A−B) between the value A set for the amount of the toner in the developer container 40 according to the image duty (ηP) of the next image, and the current value (B) set for the amount of the toner in the developer container 40 (S25). Then, it determines whether or not the calculated value (difference) is no less than the amount C (which is equal to amount by which developer container 40 can be replenished with toner by singe replenishment operation) by which the developer container 40 can be replenished with toner (A−B≥C) (S26). If A−B≥C, the control device 81 interrupts the ongoing image forming operation, and replenishes the developer container 40 with toner (S27). That is, in a case where the next image is higher in image duty than the preceding image, and the amount by which the developer container 40 needs to be replenished with toner for the formation of the next image is greater than the amount by which the developer container 40 can be replenished with toner by a single replenishment operation, the amount by which the developer container 40 has been replenished with toner cannot catch up with the amount by which the developer container 40 needs to be replenished with toner for the formation of the next image. Therefore, the control device 81 interrupts the ongoing image forming operation, and replenishes the developer container 40 with toner. Further, it repeats the above-described determination process while replenishing the developer container 40 with toner, until the amount of the toner in the developer container 40 reaches the bottom threshold value set according to the image duty of the next image. Then, as soon as the amount of the toner in the developer container 40 reaches the set value, the control device 81 makes the image forming apparatus 100 restart the interrupted image forming operation (S28), and returns to S24.

Let's assume here that images which are 50% in image duty are formed using sheets of thin paper as recording medium, after a substantial number of images which are 1% in image duty are continuously formed using sheets of thin paper as recording medium, for example. In this case, the fixation temperature is 160° C. since the recording media are sheets of thin paper. Further, the minimum amount of toner for the developer container 40 is 190 g. Therefore, the process for replenishing the developer container 40 with toner is controlled so that until the image duty becomes 50%, the amount of the toner in the developer container 40 remains at 190 g. Thus, the current value to which the amount B of the toner in the developer container 40 is set is 190 g. On the other hand, in a case where the images to be formed are 50% in image duty, the bottom threshold value for the amount of the toner in the developer container 40 is 220 g. Therefore, the amount A set for the toner in the developer container 40 according to the image duty of the next image is 220 g. Thus, if the amount C by which the developer container 40 can be replenished with toner by a single replenishment operation is 5%, A-B=220 g−190 g=30 g, and therefore, A−B (30 g)≥C (5 g) is satisfied. Therefore, the control device 81 interrupts the ongoing image forming operation, and replenishes the developer container 40 with 30 g of toner. Then, as soon as it determines, based on the signals from the toner sensor 45, that the developer container 40 has just been replenished with 30 g of toner, it stops replenishing the developer container 40 with toner, and makes the image forming apparatus 100 restart the interrupted image forming operation.

In this embodiment, the value for the minimum amount of toner for the developer container 40 is set according to the type of recording medium (sheet) following a control sequence such as the above-described one. Therefore, it is possible to prevent the problem that as the toner in the developer container 40 increases in degree of agglomeration, the developer container 40 is abnormally replenished with toner, while minimizing the length of time an image forming operation has to be interrupted for the replenishment. If no bottom limit is set for the amount of the toner in the developer container 40, the amount for the toner in the developer container 40 is set to 150 g, because the images to be formed are 1% in duty. In comparison, in the above-described case, the bottom threshold value for the amount of the toner in the developer container 40 was set to 190 g. Then, if the next image to be formed is 50% in image duty, the bottom threshold value for the amount of the toner in the developer container 40 is set to 220 g. Therefore, in case where the minimum value is not set for the amount of the toner in the developer container 40, the amount by which the developer container 40 is replenished with toner is 70 g, whereas in this embodiment is 30 g. That is, this embodiment is smaller in the amount by which the developer container 40 is to be replenished with toner than in a case where the bottom threshold is not set for the amount of the toner in the developer container 40, proving that this embodiment can minimize the length of time the ongoing image forming operation has to be interrupted to replenish the developer container 40 with toner.

In this embodiment described above, the minimum amount for the toner in the developer container 40 was set according to the fixation temperature. However, an image forming apparatus may be designed so that the minimum amount for the toner in the developer container 40 is set according to one of the other conditions set for the fixing device 6, than the fixation temperature. For example, it may be set according to the speed of the fixing device 6, that is, the speed with which a sheet of recording medium is conveyed by the combination of the heat roller 6*a* and pressure roller 6*b*. To elaborate, in some cases, an image forming apparatus is changed in processing speed according to image formation conditions, such as recording medium (sheet) type. In such cases, the fixing device of the image forming apparatus is also changed in speed. That is, the slower the fixing device in process speed, the greater the length of time toner is subjected to heat in the developer container, and therefore, the more likely it is for toner to be deteriorated in the developer container. Therefore, in a case where the fixing device is reduced in speed, the bottom threshold value for the amount of the toner in the developer container is set lower.

Further, also in a case where the developer container 40 is changed in internal temperature by the ambience of the image forming apparatus (fixing device) the bottom threshold value for the amount of the toner in the developer container may be changed as in this embodiment. Referring to FIG. 1, for example, an image forming apparatus may be designed so that a temperature sensor 120 is placed as a temperature detecting means (temperature obtaining means) in the adjacencies of the developing device 4, and the bottom threshold value for the amount of the toner in the developer container 40 is set according to the temperature detected by the temperature sensor 120. That is, the higher the temperature detected by the temperature sensor 120, the lower the bottom threshold value for the amount of the toner in the developer container is set. In other words, the information (related to temperature) related to the temperature of the toner in the developer container is obtained. Then, under the condition which makes the toner in the developer container higher in temperature, the bottom threshold value for the amount of the toner in the developer container 40 is set low, based on the obtained information. Thus, the temperature obtaining means for obtaining the information related to the temperature of the toner in the developer container may be any means as long as it is capable of detecting the internal temperature of the image forming apparatus 100, or the ambient temperature of the fixing device 6, other than the temperature sensor 120 placed in the adjacencies of the developer container as described above. Further, in the case of the embodiments described above, the control device 81 which sets the fixation temperature is equivalent to the temperature obtaining means.

Further, in this embodiment, the photosensitive drum 1 is kept stable in peripheral velocity (process speed) regardless of basis weight of recording medium (sheet). Therefore, in a case where an image is formed on both surfaces of a sheet of coated paper, which is relatively large in basis weight, the image forming apparatus 100 is increased in sheet interval. Thus, in a case where the image forming apparatus 100 is changed in sheet interval, it is designed so that the image forming apparatus 100 is controlled according to the average image duty per unit length of time the developing device 4 is driven, as in the second embodiment, in addition to the sheet interval. That is, the second and third embodiments may be combined.

Embodiment 4

Figure 19:
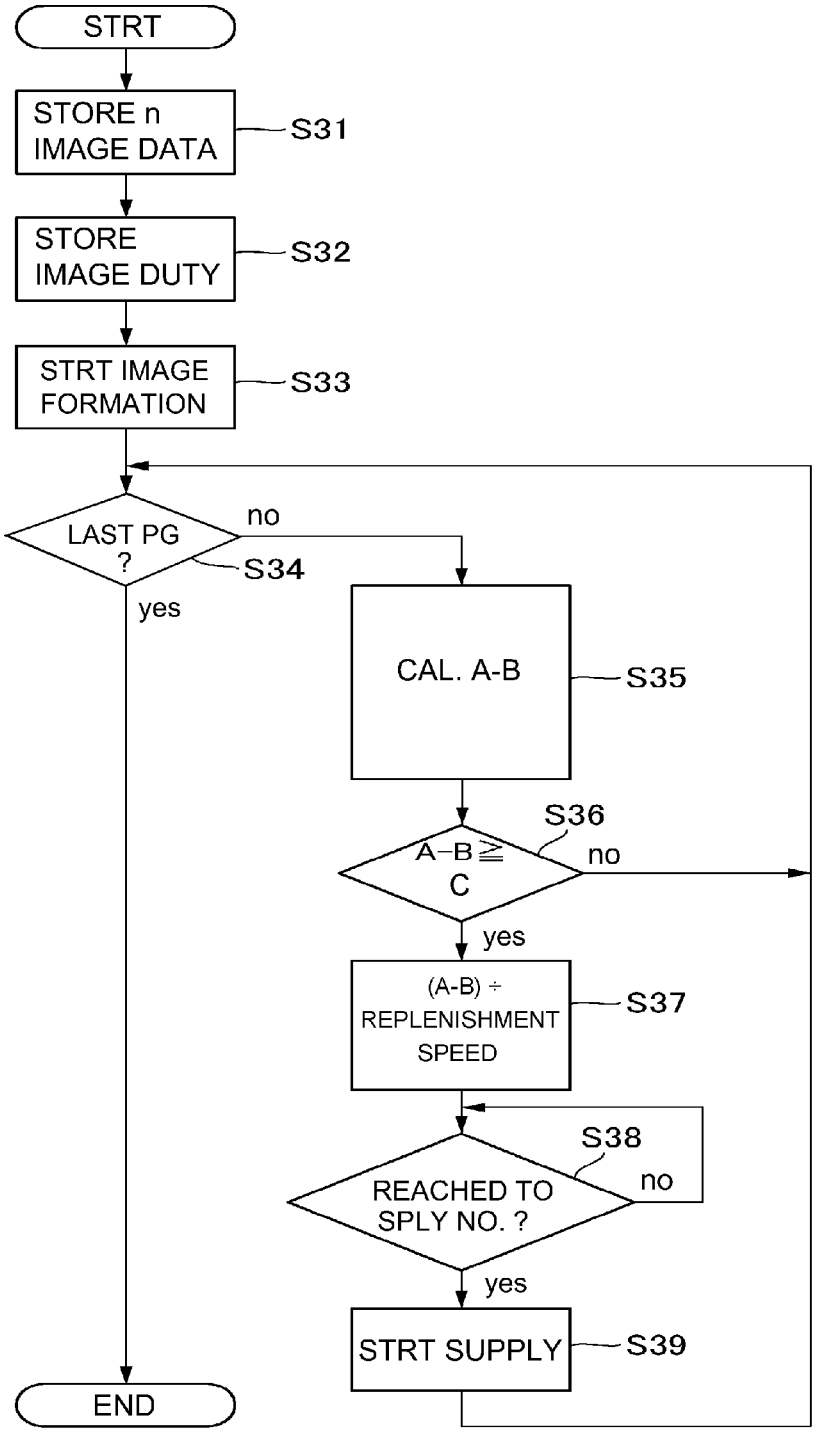
FIG. 19 is a flowchart of the control sequence for replenishing the developer container with a fresh supply of toner, in the fourth embodiment of the present invention.

Next, referring to FIG. 19 along with FIGS. 1-4, the fourth embodiment of the present invention is described. In this embodiment, the image ratio of an image to be formed after the outputting of a certain number of images is calculated in advance to determine the amount by which the developer container 40 is to be replenished with toner. Then, the operation for replenishing the developer container 40 with toner is started before the outputting of the certain number of prints is completed. Otherwise, the image forming apparatus in this embodiment is similar in structure and function to the image forming apparatus in the first embodiment. Thus, the portions of the image forming apparatus in this embodiment, which are similar in structure to the counterpart in the first embodiment are given the same referential codes as those given to the counterparts, and are not described here. That is, only the differences of this embodiment from the first embodiment are described.

In a case where images which are low in image duty are continuously formed, and then, images which are high in image duty are formed, it is desired that the developer container 40 is replenished with toner before the starting of the formation of the image which is high in image duty, so that the amount of the toner in the developer container 40 matches the image duty of the image to be formed. However, if the replenishment of the developer container with toner is started immediately before the starting of the formation of the images which are high in image duty, the length of time the ongoing image forming operation is interrupted may be longer than the preset sheet interval, because of the length of time necessary for the replenishment. On the other hand, the control device 81 can know how many prints with a low image duty have to be outputted before the starting of the printing of images with a high image duty, from the received information about the job. In this embodiment, therefore, the image forming apparatus is designed so that the replenishment of the developer container with toner is started before the starting of the formation of the images with a higher image duty. That is, the control device 81 calculates the difference between the value set for the amount of the toner in the developer container 40, according to the image duty of the second set of images to be formed after the outputting the first set of images, and the current value set for the amount of the toner in the developer container 40 to form the first set of images. Then, the operation for replenishing the developer container with toner, by the amount which corresponds to the difference, with the use of the toner replenishment roller 93, is started before the completion of the outputting of the first set of images (prints).

To describe more concretely, lets' assume here that cardstock is used as recording medium, and also that the image duty remains at 1% up to 209th print and increases to 50% at the 210th prints. While the 175th print is outputted, the average image duty of the immediately preceding 100 prints is 1%, and therefore, the amount of the toner in the developer container 40 is 150 g. That is, the value to which the amount of the toner in the developer container 40 is set at this point is 150 g.

On the other hand, the 210th print is 50% in image duty (pixel count). Therefore, the control device 81 estimates that the developer container 40 requires 220 g of toner before the starting of the outputting of the 210th prints. That is, the value set for the amount of the toner in the developer container 40 according to the image duty of the 210th print and thereafter (after outputting of 210 prints) is 220 g. Therefore, the above-described difference is 70 g (220 g−150 g).

The replenishment speed of the toner replenishment roller 93 is 5 g/sec. Thus, the calculated length of replenishment time is 14 seconds. The image forming apparatus 100 in this embodiment is capable of outputting 100 pages per minute. Therefore, the operation for replenishing the developer container 40 with toner has only to be started 24 prints (14 sec÷60 sec/min×100 page/min=23.33 . . . ) ahead of the staring of the outputting the 210th print. Thus, the control device 81 can enable the image forming apparatus 100 to form the 210th print (image) and the images thereafter, while preventing the prints from suffering from unwanted white spots, by making the image forming apparatus 100 start the replenishment at 186th print (210−24).

The number of images, the pixel count of which has to be obtained in advance, is calculated as follows. The timing with which the developer container 40 has to be replenished with a large amount of toner is when the amount of the toner in the developer container 40 is smallest, and the image duty changes to 10%. In this embodiment, it is when the amount of the toner in the developer container 40 has to be changed from 150 g to 250 g. In this case, the developer container 40 has to be replenished with 100 g (difference) of toner. The replenishment speed is 5 g/sec. Therefore, the replenishment has only to be started 20 sec prior to the starting of the outputting of the image which is 100% in image duty. That is, the replenishment has only to be started 34 prints (20 sec÷60 sec/min×100 page/min=33.33 . . . ) prior to the starting of the outputting of the image which is 100% in image duty. In this embodiment, therefore, as long as the amount of the toner which the developer container 40 is required to contain according to the image duty can be determined at least 34 prints prior to the starting of the printing of the image which is 100% in image duty, the developer container 40 can be replenished with a proper amount of toner without interrupting the ongoing image forming operation. Further, in this embodiment, the amount of toner which the developer container 40 is required to contain according to the image duty is set as small as possible as in the first embodiment. Therefore, it is possible to prevent the developer container 40 from being abnormally replenished with toner, while minimizing the toner deterioration (increase in degree of agglomeration).

Next, the replenishment operation in this embodiment is concretely described with reference to FIG. 19, which is a flowchart of the replenishment operation in this embodiment. First, the control device 81 reads the image data of 35 (n) images to be outputted, and stores the read image data in the memory 64 (FIG. 4) as a storing means (S31). During this process, the control device 81 calculates image duty (ηP) from the pixel count, and stores it in the memory 64, in addition to the image data (S32). When it starts reading the image data of the 36th image, it reads the image data from the memory 64 to output the image, and starts forming the image (S33). Thereafter, it repeats the process of renewing the pixel count (image duty), storing the image data, and reading the image data, for each image to be formed. Further, it calculates the bottom threshold value for the amount of the toner in the developer container 40, based on the average value (ηPave) of the image duty per unit length of time the developing device 4 was driven to output the preceding 100 prints, as in the second embodiment. Thus, it is possible for the control device 81 to calculate the image duty of the images to be formed in advance, by 35 images.

If the image to be formed is not the last one (S34), the control device 81 calculates the difference between the amount A of the toner (required by developer container 40) which will be necessary after the outputting of 35 prints, and the current amount B of the toner in the developer container 40 (S35). Then, it determines whether or not the difference (A−B) is no less than the amount C (A−B≥C) by which the developer container 40 can be replenished by the toner replenishment roller 93 per print (amount of toner with which developer container 40 can be replenished by toner replenishment roller 93 by the time when the formation of the next image is started) (S36). If (A−B)≤C, the control device 81 returns to S34 to determine whether or not the next image to be formed is the last one. If the difference is greater than the amount by which the developer container 40 can be replenished with toner by the toner replenishment roller 93 per image, the control device 81 divides the difference by the replenishment speed to calculate how early, in terms of image count, the replenishment operation has to be started in order to replenish the developer container 40 with a necessary amount of toner by the time the images with a higher image duty begin to be outputted (S37). Then, as soon as the number of the outputted images reaches the calculated one (S38), the control device 81 starts the toner replenishment (S39). Thus, even an image forming operation in which the developer container 40 has to be sharply increased in the amount of the toner therein, during the operation, does not need to be interrupted to replenish the developer container 40 with toner. In this embodiment, the image forming apparatus 100 is structured so that its control device 81 starts reading the image data earlier by 35 in terms of image count prior to the starting of the formation of the images with higher image duty. However, this image count is optional. That is, it may be set according to the performance of each image forming apparatus.

<Miscellanies>

In each of the preceding embodiments of the present invention described above, the image forming apparatus was designed to form image with the use of magnetic single-component toner. However, the preceding embodiments are not intended to limit the present invention in scope in terms of toner type. That is, the present invention is also applicable to any image formation system (apparatus) which is designed so that replenishing a developer container with developer does not affect image density, that is, the developer container can be controlled in the amount of the toner therein, without affecting image density. That is, the application of the present invention is not limited by toner type, for example, nonmagnetic single-component. That is, it is desired that an image forming apparatus to which the present invention is applied uses single-component developer which contains toner.

Further, in each of the preceding embodiments of the present invention described above, the image forming apparatus was a monochromatic (black-and-white) image forming apparatus. However, the present invention is also applicable to various multicolor image forming apparatuses, including a full-color image forming apparatus. Further, the present invention can be embodied in the form of a combination of some of the preceding embodiments, for example, a combination of the third and second embodiments, a combination of the third and second embodiments, a combination of the third and fourth embodiment, or a combination of all of the second, third, and fourth embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-224084 filed on Nov. 16, 2015, which is hereby incorporated by reference herein in its entirety.

What is claimed is:

1. An image forming apparatus comprising:

an image bearing member;

a developing device including a developing container accommodating a one component developer including toner, and a developer detecting portion configured to detect the developer in said developing container, said developing device being configured to develop an electrostatic latent image formed on said image bearing member with the toner;

a developer supply portion configured to supply the developer into said developing container in accordance with a detection result of said developer detecting portion; and a controller to control developer supply means, in which a developer amount in said developing container when an image ratio of images formed by a predetermined number of image formations is a first image ratio is larger than the developer amount in said developing container when the image ratio of the images formed by a predetermined image formations is a second image ratio which is smaller than the first image ratio.

2. An apparatus according to claim 1, wherein A-BC is satisfied, where A is the developer amount in said developing container set in accordance with the image ratio of a next image, B is a current setting of the developer amount in said developing container, and C is a developer amount capable of being supplied by said developer supply means until formation of the next image.

3. An apparatus according to claim 1, wherein the developer contains the toner, and said apparatus includes a fixing device configured to fix the toner image transferred from said image bearing member, on a sheet, and said controller sets a lower limit value of the developer amount in said developing container set in accordance with the image ratio, in accordance with a condition of said fixing device.

4. An apparatus according to claim 3, wherein the condition of said fixing device is a temperature of said fixing device, and wherein when the temperature of said fixing device is a first temperature, said controller sets the lower limit value to a first lower limit value, and when the temperature of said fixing device is a second temperature higher than the first temperature, said controller sets the lower limit value to a second lower limit value which is lower than the first lower limit value.

5. An apparatus according to claim 1, further comprising a temperature acquiring means configured to acquire information relating to a temperature of developer in said developing container, wherein said controller sets a lower limit value of the developer amount in said developing container set in accordance with the image ratio, in accordance with the temperature acquired by said temperature acquiring means.

6. An apparatus according to claim 5, wherein said temperature acquiring means is a temperature detecting means configured to detect a temperature adjacent to said developing device.

7. An image forming apparatus comprising:

an image bearing member;

a developing device including a developing container accommodating a one component developer including toner, and a developer detecting portion configured to detect the developer in said developing container, said developing device being configured to develop an electrostatic latent image formed on said image bearing member with the toner;

a developer supply portion configured to supply the developer into said developing container in accordance with a detection result of said developer detecting portion; and a controller to control a developer supply device, in which a developer amount in said developing container when an image ratio of images formed in a predetermined image forming operation period is a first image ratio is larger than the developer amount in said developing container when the image ratio of the images formed in a predetermined image forming operation period is a second image ratio which is smaller than the first image ratio.

8. An apparatus according to claim 7, wherein the image ratio of the images formed in the predetermined image forming operation period includes the image ratio of an inputted image, and the image ratio of the toner image formed for adjustment of said image forming apparatus.

9. An apparatus according to claim 7, wherein A-BC is satisfied, where A is the developer amount in said developing container set in accordance with the image ratio of a next image, B is a current setting of the developer amount in said developing container, and C is a developer amount capable of being supplied by said developer supply means until formation of the next image.

10. An apparatus according to claim 7, wherein the developer contains the toner, and said apparatus includes a fixing device configured to fix the toner image transferred from said image bearing member, on a sheet, and said controller sets a lower limit value of the developer amount in said developing container set in accordance with the image ratio, in accordance with a condition of said fixing device.

11. An apparatus according to claim 10, wherein the condition of said fixing device is a temperature of said fixing device, and wherein when the temperature of said fixing device is a first temperature, said controller sets the lower limit value to a first lower limit value, and when the temperature of said fixing device is a second temperature higher than the first temperature, said controller sets the lower limit value to a second lower limit value which is lower than the first lower limit value.

12. An apparatus according to claim 7, further comprising a temperature acquiring means configured to acquire information relating to a temperature of developer in said developing container, wherein said controller sets a lower limit value of the developer amount in said developing container set in accordance with the image ratio, in accordance with the temperature acquired by said temperature acquiring means.

13. An apparatus according to claim 12, wherein said temperature acquiring means is a temperature detecting means configured to detect a temperature adjacent to said developing device.

* * * * *